US011242579B2

(12) United States Patent
Rijkenberg et al.

(10) Patent No.: US 11,242,579 B2
(45) Date of Patent: Feb. 8, 2022

(54) METHOD OF PRODUCING A HOT-ROLLED HIGH-STRENGTH STEEL WITH EXCELLENT STRETCH-FLANGE FORMABILITY AND EDGE FATIGUE PERFORMANCE

(71) Applicant: TATA STEEL IJMUIDEN B.V., Velsen-Noord (NL)

(72) Inventors: Rolf Arjan Rijkenberg, Santpoort-Noord (NL); Maxim Peter Aarnts, Castricum (NL); Paul Joseph Bellina, Haarlem (NL); Andrew Paul Vass, Amstelveen (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 312 days.

(21) Appl. No.: 16/331,324

(22) PCT Filed: Sep. 22, 2017

(86) PCT No.: PCT/EP2017/074072
§ 371 (c)(1),
(2) Date: Mar. 7, 2019

(87) PCT Pub. No.: WO2018/055098
PCT Pub. Date: Mar. 29, 2018

(65) Prior Publication Data

US 2019/0352736 A1 Nov. 21, 2019

(30) Foreign Application Priority Data

Sep. 22, 2016 (EP) ..... 16190061

(51) Int. Cl.

| | |
|---|---|
| ***C21D 9/52*** | (2006.01) |
| ***C21D 9/46*** | (2006.01) |
| ***C21D 8/02*** | (2006.01) |
| ***C21D 6/00*** | (2006.01) |
| ***C22C 38/12*** | (2006.01) |
| ***C22C 38/04*** | (2006.01) |
| ***C22C 38/02*** | (2006.01) |
| ***C22C 38/00*** | (2006.01) |
| ***C22C 38/06*** | (2006.01) |

(52) U.S. Cl.

CPC ..... *C21D 9/52* (2013.01); *C21D 6/005* (2013.01); *C21D 6/008* (2013.01); *C21D 8/0205* (2013.01); *C21D 8/0226* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C21D 2211/001* (2013.01); *C21D 2211/002* (2013.01); *C21D 2211/005* (2013.01)

(58) Field of Classification Search
None
See application file for complete search history.

(56) References Cited

U.S. PATENT DOCUMENTS

| | | | | |
|---|---|---|---|---|
| 2011/0017360 | A1 | 1/2011 | Yoshinaga et al. | |
| 2014/0000766 | A1 | 1/2014 | Maeda et al. | |
| 2015/0354021 | A1* | 12/2015 | Rijkenberg | C21D 9/46 428/653 |
| 2016/0199892 | A1 | 7/2016 | Ko et al. | |
| 2018/0209007 | A1* | 7/2018 | Sugiura | C21D 9/46 |

FOREIGN PATENT DOCUMENTS

| | | | |
|---|---|---|---|
| EP | 1338665 | A1 | 8/2003 |
| EP | 2826881 | A1 | 1/2015 |
| EP | 2952604 | A1 | 12/2015 |
| EP | 2954074 | A1 | 12/2015 |
| EP | 2987883 | A1 | 2/2016 |
| JP | 2004-162107 | A | 6/2004 |
| JP | 2008-285741 | A | 11/2008 |
| KR | 10-2010-00358 | B1 | 8/2019 |
| WO | 2012/128206 | A1 | 9/2012 |
| WO | 2013167572 | A1 | 11/2013 |
| WO | 2014122215 | A1 | 8/2014 |

OTHER PUBLICATIONS

Suebsomran, Anan, and Suthep Butdee. "Cooling process on a run-out table by the simulation method." Case Studies in Thermal Engineering 1.1 (2013): 51-56. (Year: 2013).*

International Search Report and Written Opinion dated Nov. 30, 2017 for PCT/EP2017/074072 to Tata Steel Ijmuiden B.V. filed Sep. 22, 2017.

Indian Office Action dated Oct. 5, 2021 in Indian Application No. 201947015178.

* cited by examiner

*Primary Examiner* — Anthony M Liang
(74) *Attorney, Agent, or Firm* — Vorys, Sater, Seymour and Pease LLP

(57) ABSTRACT

A method to manufacture a hot-rolled high-strength steel sheet or strip with tensile strength of 570 MPa or higher, or preferably 780 MPa or higher, or even more preferably 980 MPa or higher, with an excellent combination of tensile elongation, SFF, and PEF strength.

26 Claims, 3 Drawing Sheets

METHOD OF PRODUCING A HOT-ROLLED HIGH-STRENGTH STEEL WITH EXCELLENT STRETCH-FLANGE FORMABILITY AND EDGE FATIGUE PERFORMANCE

CROSS-REFERENCE TO RELATED APPLICATIONS

This is a § 371 National Stage Application of International Application No. PCT/EP2017/074072 filed on Sep. 22, 2017, claiming the priority of European Patent Application No. 16190061.8 filed on Sep. 22, 2016.

This invention relates to a method to manufacture a hot-rolled high-strength steel sheet or strip suitable for automotive chassis components or the like and, more particularly, to a method to manufacture a hot-rolled high-strength steel strip with tensile strength of at least 570 MPa, preferably of at least 780 MPa, more preferably of at least 980 MPa, with an excellent combination of tensile elongation and stretch-flange formability (SFF), and good punched-edge fatigue (PEF) strength.

Increasing pressure from stringent environmental legislation and vehicle safety regulations force the automotive industry to continuously look for cost-effective options to reduce fuel consumption and greenhouse gas emissions without compromising passenger safety or driving performance. Reducing vehicle weight by exploiting new and innovative high-strength steels with thinner gauges is one of the options for the automotive industry.

In terms of formability these steels should offer sufficient stretchability in combination with sufficient strength-flange formability as this will allow increased freedom to formulate new light-weight chassis designs in which the intrinsic loss in stiffness from using thinner gauges is compensated with geometry modifications. As hole-expansion capacity (HEC) is regarded as a good measure for the degree of SFF, this implies that these steels should offer a sound balance between tensile elongation and HEC. The fatigue performance of sheared- or punched-edges present in the final component is also important.

Advanced High Strength Steel (AHSS) grades such as Dual-Phase (DP), Ferrite-Bainite (FB) or Complex Phase (CP) steels that have been developed to replace conventional HSLA grades, largely rely for their strength on a multi-phase microstructure in which the ferrite or bainite matrix is strengthened with martensite or potentially retained-austenite islands.

AHSS grades with their multi-phase microstructures are limited when compared with nano-precipitation (NP) strengthened single-phase ferritic high-strength steel grades with equivalent tensile strength. The reason for this is that the difference in hardness between the ferrite or bainite matrix and low-temperature transformation constituents in the AHSS microstructures promotes micro-voids upon shearing or punching in the interior of the steel close to the cut edge. In turn, these micro-voids can impair HEC as forming may lead to void growth and coalescence, leading to premature macroscopic failure, i.e., one or more through-thickness cracks. Furthermore, the presence of two or more phase constituents with different hardness, such as present in aforementioned AHSS grades, but also in HSLA where ferrite is combined with (coarse) cementite and/or pearlite, can also lead to an increase in the roughness of the fracture zone of the punched or sheared edge. An increase in the roughness of this fracture zone can lead to a significant decrease of the punched- or sheared-edge fatigue strength.

In contrast to the aforementioned AHSS grades, the NP steels have a homogeneous microstructure consisting essentially exclusively of ferrite for high ductility and rely for strength to a large degree on precipitation hardening via a high density of nanometer-sized composite precipitates, making them less susceptible to the formation of micro-voids upon shearing or punching. These NP steels offer an improved balance between tensile elongation and HEC compared with multi-phase AHSS or HSLA grades with equivalent tensile strength.

EP1338665, EP12167140, and EP13154825 relate to hot-rolled nano-precipitation strengthened single-phase ferritic high-strength steels and employ different combinations of Ti, Mo, Nb and V to achieve the desired properties.

SUMMARY OF THE INVENTION

Several factors play a crucial role in determining the HEC of steels. Apart from an inherent relationship with the tensile strength of the steel and microstructural characteristics with regard to hard second phase constituents in relation to damage resistance upon shearing or punching, it is well accepted that trace elements and—in particular—sulphide- and/or oxide-based inclusions from the steel-making process may have a profound impact on HEC and fatigue strength because they act as stress raisers and may act as potential nucleation sites for the formation of micro-voids upon deformation operations like shearing or punching. The same holds for (centre line) segregation, which can have a deleterious effect on PEF as centre line segregation may promote splitting upon punching. The objective of the present invention is to provide a method to manufacture a hot-rolled high-strength steel sheet or strip with tensile strength of 570 MPa or higher with an excellent combination of tensile elongation and SFF, and good PEF strength.

A further objective of the present invention is to provide a method to manufacture a hot-rolled high-strength steel sheet or strip with tensile strength of 780 MPa or higher with an excellent combination of tensile elongation and SFF, and good PEF strength.

Still a further objective of the present invention is to provide a method to manufacture a hot-rolled high-strength steel sheet or strip with tensile strength of 980 MPa or higher with an excellent combination of tensile elongation and SFF, and good PEF strength.

A further object of the invention is to provide a method to manufacture a hot-rolled high-strength steel sheet or strip according to the objectives described hereinabove wherein the steel is suitable for the manufacturing of automotive chassis components or the like.

One or more of these objects may be reached with the method according to the main claim, or with the method according to one of the dependent claims. It must be noted that all compositions are expressed in weight percent (wt %) unless otherwise indicated.

DETAILED DESCRIPTION

Figure 1A:
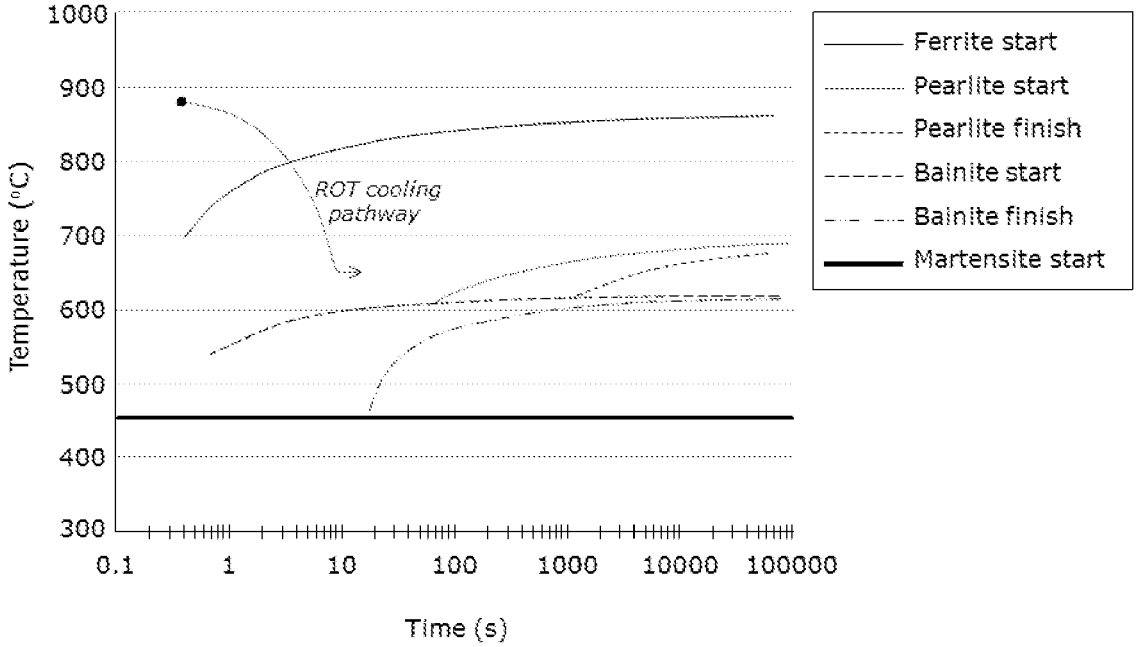
FIG. 1*a* shows a calculated Continuous Cooling Transformation (CCT) diagram, wherein FIG. 1*a* reflects the situation of a low FRT.

The invention provides a method for manufacturing a hot-rolled high-strength steel strip suitable for instance for automotive chassis components or the like and, more particularly, to a method to manufacture a hot-rolled high-strength steel sheet or strip with a tensile strength of 570 MPa or higher, or preferably 780 MPa or higher, with an excellent combination of tensile elongation and SFF, and good PEF strength. From the strip sheet material or blanks may be produced by conventional means such as cutting and/or punching.

The method relates in particular to the thermo-mechanical pathway during hot rolling, the cooling trajectory on the run-out-table (ROT) to the coiling temperature and subsequent cooling of the steel sheet or strip to ambient temperature. An optional element in the method of manufacturing said steel is the use of a calcium treatment during steel making to prevent clogging for improved casting performance and to modify sulphide- and/or oxide-based inclusions. A further optional element is to control process conditions during steel making, casting, and solidification in such a way that the degree of segregation, and in particular centre line segregation, in terms of enrichment of cementite and/or alloying elements or inevitable impurities in the slab and final steel strip is kept to a minimum by limiting the super-heat and intensifying the cooling during casting and limiting the S content. To minimise, or preferably prevent splitting of the steel upon punching or shearing, it is preferred to minimise the fraction of sulphide- and/or oxide-based inclusions with a diameter of 1 μm or higher in the steel and to minimise the degree of segregation, in particular centre line segregation, in terms of enrichment of cementite and/or alloying elements or inevitable impurities. To suppress the amount of composite $Al_xO_y$ inclusions in the final steel, it is preferred not to use a calcium treatment and to give sufficient time during steel making to let inclusions rise out as well as to keep S content at a minimum, preferably at most 0.003%, more preferably at most 0.002%, and most preferably at most 0.001%.

The proposed method for manufacturing said hot-rolled high-strength formable steel sheet or strip solves the problem of premature edge cracking during stretch-flanging operations required for the manufacturing of automotive chassis components or the like. Furthermore, the proposed method for manufacturing in the present invention solves the problem of premature fatigue failure of punched or sheared edges of said hot-rolled high-strength formable steel sheet or strip when used to form automotive chassis components or the like and when subjected to cyclic loading during in-service conditions.

As such, the invention provides a hot-rolled high-strength steel that apart from an excellent combination of tensile elongation and HEC offers good resistance to edge splitting as a result of punching or shearing and good punched- or sheared-edge fatigue. The excellent combination of strength, elongation, and HEC is derived from a ductile and substantially single-phase ferritic microstructure that is strengthened with a high density of fine composite carbide and/or carbo-nitride precipitates containing V and optionally Mo and/or Nb. The substantially single-phase ferritic nature of the microstructure and the fact that the local difference in hardness within the microstructure is kept to a minimum ensures that stress localisation during deformation and hence the nucleation of voids and premature macroscopic failure is suppressed.

In the present invention the microstructure is considered as substantially single-phase ferritic if the volume fraction of all ferritic phase constituents is at least 95 vol. %, and preferably at least 97 vol. %, and the combined fraction of cementite and pearlite is at most 5 vol. %, or preferably at most 3 vol. %. This minor fraction of cementite and pearlite can be tolerated in the present invention because it does not substantially adversely affect the relevant properties of the steel (HEC, PEF, $Rp_{0.2}$, Rm, and A50).

The role of the specific manufacturing steps of the steel sheet or strip for the present invention will now be described.

Slab reheating temperature (SRT): The slab reheating in the furnace of the hot-strip mill or reheating the solidified slab in an integrated casting and rolling facility ensures that practically all composite carbide and carbo-nitride precipitates containing V and/or optionally Nb, are dissolved. This will ensure that sufficient V and/or optionally Nb is present in solid-solution in the austenitic matrix for sufficient precipitation hardening upon cooling down the steel sheet or strip on the ROT and/or coiler after hot rolling. Inventors found that an SRT of 1050 to 1260° C. suffices, depending on the amount of micro-alloying used. An SRT below 1050° C. will lead to insufficient dissolution and hence result in too low strength, whereas an SRT above 1260° C. will increase the risk of abnormal grain growth during reheating and promote an inhomogeneous grain structure, which can adversely affect formability.

Figure 1B:
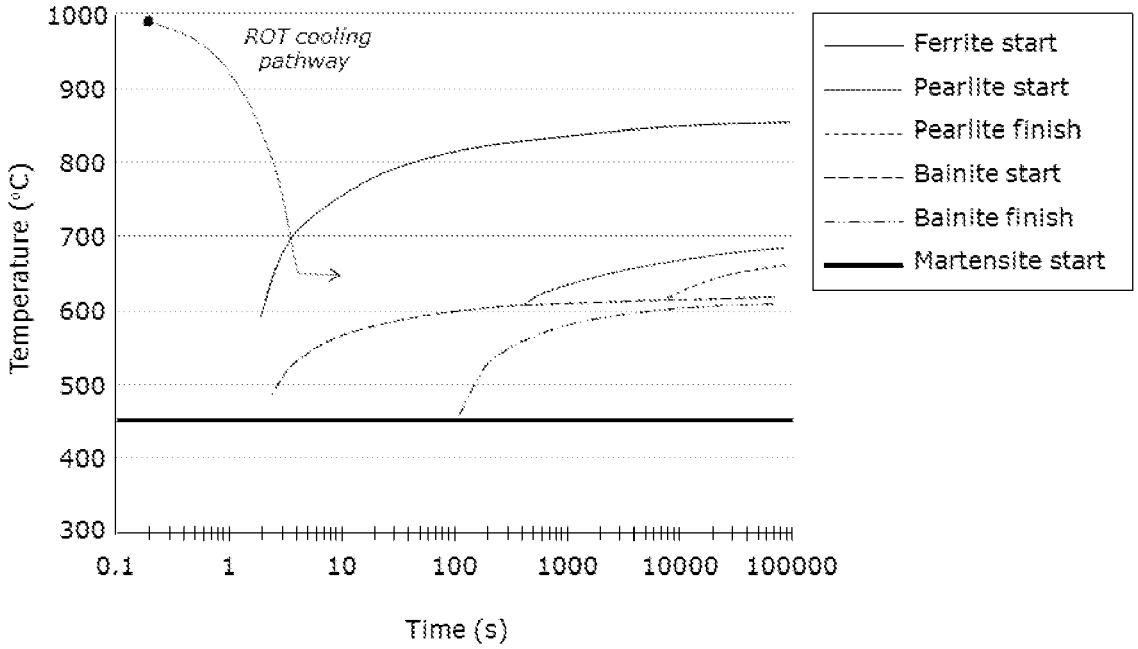
FIG. 1*b* shows a calculated Continuous Cooling Transformation (CCT) diagram, wherein FIG. 1*b* reflects a high FRT.

Entry temperature of the last finish rolling stand ($T_{in,\ FT7}$): A sufficiently high $T_{in,\ FT7}$ is required to ensure optimum austenite conditioning prior to transformation once the steel sheet or strip is actively cooled down on the ROT to the coiling temperature. To illustrate schematically the influence of austenite condition, FIG. 1*a* and FIG. 1*b* show calculated Continuous Cooling Transformation (CCT) diagrams for a 0.055C-1.4Mn-0.2Si-0.02Al-0.06Nb-0.22V-0.15Mo-0.01N alloy. In FIG. 1*a*, austenitisation at 890° C. and an austenite grain size of 10 μm, whereas for the CCT diagram of FIG. 1*b*, an austenitisation temperature of 1000° C. and an austenite grain size of 50 μm was used as input. Indicated in both CCT diagrams is an exemplary ROT cooling trajectory considered as comparative in case of FIG. 1*a* and considered as inventive in case of FIG. 1*b*.

Too low a $T_{in,\ FT7}$ will lead to an austenite condition that accelerates ferrite transformation and promotes the formation of polygonal ferrite. Although a substantial fraction of polygonal ferrite is beneficial for tensile elongation, inventors found that too low a $T_{in,\ FT7}$ can adversely affect HEC and PEF. On the other hand, too high a $T_{in,\ FT7}$ will lead to an austenite condition which will shift the ferrite transformation region too far away, promoting too much hardenability and too high a fraction of acicular/bainitic ferrite or potentially even ultimately other, hard transformation products formed at lower transformation temperatures. This would come at the expense of tensile elongation or could even impair HEC. Inventors found that for the present invention to have an optimum balance between HEC and tensile elongation based on a suitable microstructure containing a mixture of polygonal and acicular/bainitic ferrite, a $T_{in,\ FT7}$ between 980 and 1100° C. is suitable when combined with the SRT, FRT, ROT-cooling trajectory, and CT as specified in the present invention.

Finish rolling temperature (FRT): Inventors found that an FRT between 950 and 1080° C. is suitable when combined with the SRT, $T_{in,\ FT7}$, ROT-cooling trajectory, and CT as specified in the present invention.

Primary run-out-table cooling rate ($CR_1$): Given that $T_{in,FT7}$ and the FRT are in the claimed range, the primary cooling rate of the steel sheet or strip directly at the start of the ROT should be sufficiently intense to ensure that austenite-to-ferrite transformation starts at relatively low ferrite transformation temperatures, promoting acicular/bainitic ferrite. This is also schematically illustrated in FIG. 1*a* and FIG. *b*. FIG. 1*a* reflects the situation of a low FRT, whereas FIG. 1*b* reflects the high FRT. Indicated in both CCT diagrams is a ROT-cooling trajectory. In case of FIG. 1*a* the primary cooling rate is about 25° C./s (comparative) and in case of FIG. 1*b* a primary cooling rate of about 85° C./s (inventive). It is clear from the calculated CCT diagrams in FIG. 1*a* and FIG. 1*b* that an intense primary cooling on the ROT in combination with aforementioned finish rolling conditions results in hitting the ferrite transformation nose in the CCT diagram to promote the formation of acicular/bainitic ferrite.

The nucleation of acicular/bainitic ferrite phase constituents with their intricate crystallographic morphology is essential for the present invention. In contrast to polygonal ferrite that nucleates foremost on prior austenite grain boundaries, acicular/bainitic ferrite will partially nucleate on inevitable inclusions present in the steel matrix. In particular acicular ferrite is considered to be an effective agent in this context and is capable to encapsulate inclusions in a locally fine-grained environment, which reduces their harmful impact upon deformation operations, including punching, stretch-flanging and cyclic fatigue loading.

Inventors have found that a suitable range for the intense primary ROT cooling rate ($CR_1$) is between 50 and 150° C./s combined with the SRT, $T_{in,\ FT7}$, ROT-cooling trajectory, and CT as specified in the present invention.

Intermediate run-out-table temperature ($T_{int,ROT}$) after primary cooling rate $CR_1$: The intense primary cooling cool down the steel strip rapidly from the FRT to an intermediate ROT temperature between 600 and 720° C. This ROT setting, combined with the high FRT, promotes a shift in ferrite morphology from polygonal ferrite to acicular/bainitic ferrite and hence promotes an increased performance with regard to HEC and PEF and accommodates the fast kinetics required for both random and interphase precipitation to consume carbon and to suppress the formation of cementite and/or pearlite as well as to stimulate further efficient austenite-to-ferrite transformation.

Secondary run-out-table cooling rate ($CR_2$): The second stage in the ROT cooling trajectory is one of three variants to reach the CT:

- holding the steel sheet or strip isothermally to reach the CT, or
- mild cooling the steel sheet or strip between −20 to 0° C./s to reach the CT, or
- mild heating the steel sheet or strip between 0 and +10° C./s to reach the specified CT. This heating up of the steel sheet or strip occurs naturally because of the latent heat from the austenite-to-ferrite phase transformation occurring on the ROT.

This second stage of little or no active cooling to reach the CT is beneficial to improve product consistency along the width of the steel sheet or strip and is beneficial to promote further transformation from austenite-to-ferrite and to provide sufficient precipitation kinetics for either random precipitation or interphase precipitation.

Coiling temperature (CT): The CT determines partially the final stage of austenite-to-ferrite transformation, but also largely the final stage of precipitation. A too low CT will suppress or prevent any further precipitation during coiling and/or subsequent coil cooling and hence may lead to incomplete precipitation strengthening. Furthermore, a too low CT may lead to the presence of low-temperature phase transformation products like lower bainite, martensite and/or retained-austenite. The presence of these phase constituents can be at the expense of tensile elongation or impair hole-expansion capacity. A too high CT can lead to a too high fraction of coarse-grained polygonal ferrite and promote excessive coarsening of precipitates and hence lead to an inferior degree of precipitation strengthening during coiling and/or coil cooling. The former can lead to too low HEC and/or PEF and may lead to increased risk of splitting upon cutting, shearing, or punching of the steel sheet or strip. A suitable range for the coiling temperature is 580 to 660° C.

The role of the individual alloying elements in the steel sheet or strip will now be described. All compositions are given in weight % (%), unless indicated otherwise.

Carbon (C) is added to form carbide and carbo-nitride precipitates with V, and optionally Nb and/or Mo to gain sufficient precipitation strengthening of the ferrite phase constituents, i.e., polygonal ferrite and acicular/bainitic ferrite. The amount of C in the steel should on the one hand be sufficiently high in relation to the amount of V and optionally Nb and/or Mo used to realise sufficient precipitation strengthening of the ferrite microstructure to ensure a tensile strength of 570 MPa or higher, or preferably 780 MPa or higher. On the other hand, the C content should not be too high as that can promote the formation of (coarse) cementite and/or pearlite in the final microstructure, which in turn can impair hole-expansion capacity. The amount of C should be between 0.015 and 0.15%. A suitable minimum value is 0.02%. A suitable maximum value is 0.12%.

Silicon (Si) is an effective alloying element to gain solid-solution strengthening of the ferrite matrix. Furthermore, Si can retard or even fully suppress the formation of cementite and/or pearlite, which in turn is beneficial for hole-expansion capacity. However, a low Si content is desired since Si increases substantially the rolling loads in the mill compromising dimensional window and additionally may lead to surface issues with regard to oxide scale on the steel sheet or strip, which in turn can impair substrate fatigue properties. For that reason the Si content should not exceed 0.5%. A suitable minimum value is 0.01%. A suitable maximum value is 0.45%, or 0.32%.

Manganese (Mn) provides solid-solution strengthening and suppresses the ferritic transformation temperature as well as decreases the ferrite transformation rate. The latter aspect makes Mn an effective agent to retard the ferrite transformation region in and to promote acicular/bainitic ferrite in combination with suitable finishing rolling conditions and a sufficiently high cooling rate of the steel sheet or strip. In this context, Mn is not only important to gain sufficient solid-solution strengthening but—more importantly—to achieve the desired ferritic microstructure, consisting of a mixture of polygonal and acicular/bainitic ferrite. This in turn is important as this microstructure consisting of a mixture of these ferrite phase constituents is found to be capable to provide the required balance between HEC and tensile strength and elongation. Furthermore, as Mn suppresses the ferrite transformation, it is believed to contribute to the degree of precipitation strengthening during transformation. However, too high Mn is to be avoided as this may lead to (centre line) segregation, which in turn may cause splitting when the steel sheet or strip is cut or punched and subsequently may impair HEC and/or PEF. Therefore, the Mn content should be in the range of 1.0 to 2.0%. A suitable minimum value is 1.2%. A suitable maximum value is 1.8%.

Phosphor (P) provides solid-solution strengthening. However, at high levels, segregation of P can impair hole-expansion capacity. Therefore, the P content should be 0.06% or less, or preferably be at most 0.02%.

Sulphur (S) content should at most 0.008% as a too high S content will promote undesired sulphide-based inclusions and hence can impair HEC and PEF. Hence, efforts to realize a low S content during steel making are recommended for the present invention to obtain high HEC and good PEF. A calcium (Ca) treatment may be beneficial to modify—in particular—MnS stringer to improve formability in general or to improve castability and to prevent clogging issues during casting by modifying $Al_xO_y$-based inclusions. However, there is a risk that the amount of $Al_xO_y$ based inclusions in the steel strip increases, which can be at the expense of HEC and/or PEF. Consequently the calcium-treatment is optional. It is preferred for the present invention that the S content is kept at a minimum, preferably at most 0.003%, more preferably at most 0.002%, and most preferably at most 0.001%. It is preferred that, in addition to a S content of at most 0.003%, more preferably at most 0.002%, and most preferably at most 0.001%, no calcium-treatment is used.

Aluminium (Al) is added to the steel as a deoxidizer and can contribute to grain size control during reheating and hot rolling. The Al content in the steel (Al_tot) consists of:

- Al bound into oxides (Al_ox) as a result of the killing of the steel, and which have not been removed from the melt during steelmaking and casting, and
- Al, either in solid solution in the steel matrix or present as AlN precipitates (Al_sol).

The Al in solid solution in the steel matrix and the Al present as nitride precipitates may be dissolved in acid to measure its content and this is here defined as soluble Al (Al_sol). Too high Al, either present in solid solution (Al_sol) or present in the steel as oxide-based inclusions (inclusions containing $Al_xO_y$), can impair hole-expansion capacity. Therefore, the total Al content should be 0.12% or less and Al_sol should be at most 0.1%. The present invention relies to a large extent for precipitation strengthening on the use of elevated levels of Vanadium (V) to form composite carbide and/or carbo-nitride precipitates. It is known that carbo-nitride precipitates are less prone to coarsening than carbide precipitates. To ensure an optimised degree of precipitation strengthening with the amount of V used, elevated levels of Nitrogen (N) may be used. If this alloy approach is taken, it is preferred that the amount of Al is kept low in order to prevent that N is scavenged and tied up by Al to form AlN precipitates. In this context, a low Al content is preferred to keep V (as well as optionally Nb) free to engage with N in the precipitation process to form—apart from carbide precipitates—carbo-nitride precipitates. Hence, Al_sol in the present invention is preferably at most 0.065%, more preferably at most 0.045%, and most preferably at most 0.035%. A suitable minimum content for Al_sol is 0.005%.

Niobium (Nb) is important in relation to austenite conditioning during hot rolling and hence on the austenite-to-ferrite phase transformation and ferrite morphology and grain size. As Nb retards the recrystallisation during the final stages of hot rolling, it can play an important role to control the austenite condition, i.e., the austenite grain size prior to transformation to ferrite as well as its shape (equi-axed versus pancaked) and degree of internal dislocations when rolling below the non-recrystallisation temperature (Tnr). In turn, the austenite condition can have a substantial impact on the austenite-to-ferrite transformation, in particular with a suitable cooling trajectory on the ROT immediately after hot rolling. Polygonal (equi-axed) ferrite nucleation, nucleating preferentially on prior austenite grain boundaries and triple points, will be retarded if the density of austenite grain boundary is suppressed. Given a suitable ROT cooling trajectory after hot rolling, the subsequent decrease of equi-axed, polygonal ferrite will be accompanied by an increase of ferrite phase constituents with a more irregular shaped morphology, i.e., acicular and/or bainitic ferrite. These phase constituents will preferentially nucleate on austenite grain boundaries and grow inwardly and—in case of acicular ferrite—also on inclusions present in the steel. In particular this latter feature is crucial for the present invention because these encapsulated inclusions in a fine-grained matrix have no, or a reduced impact upon punching performance and/or will reduce their negative influence on HEC and/or PEF. The use of Nb is optional. However, when used, the Nb content should be at most 0.1% since too high Nb content can lead to segregation, which impairs both formability and fatigue performance. Furthermore, above 0.1% Nb will lose its efficiency for austenite conditioning. A suitable minimum content for Nb when used is 0.01%. Apart from the effect of Nb on austenite conditioning and indirectly on phase transformation and ferrite morphology and grain size, Nb is able to combine with C and N and to lead to carbide and/or carbo-nitride precipitates. These precipitates, when formed in ferrite during or after austenite-to-ferrite transformation, will bring strength via precipitation hardening and will promote strength as well as contribute to formability with C being scavenged in the precipitation process. A suitable minimum Nb value is 0.02%. A suitable maximum value is 0.08%.

Vanadium (V) provides precipitation strengthening. The precipitation strengthening with fine V-based composite carbides and/or carbo-nitride precipitates is crucial to achieve the desired strength level based on a single-phase ferritic microstructure in combination with high tensile elongation and high HEC as well as good PEF. To achieve this microstructure with aforementioned properties, it is crucial that V, in addition to other precipitating elements like Nb and/or Mo, consumes practically all C to suppress or even fully prevent the formation of (coarse) cementite and/or pearlite in the final microstructure. The V content should be in the range of 0.02 to 0.45%. A suitable minimum value is 0.12%. A suitable maximum value is 0.35%, or even 0.32%.

Molybdenum (Mo) is relevant for the present invention in a number of ways. Firstly, Mo retards the mobility of the austenite-ferrite interface during transformation and subsequently retards the formation and growth of ferrite. In combination with suitable finish rolling conditions and ROT cooling trajectory, the presence of Mo is beneficial to promote acicular/bainitic ferrite at the expense of polygonal ferrite, thereby promoting HEC. Secondly, Mo suppresses or even completely prevents the formation of pearlite. The latter is crucial for the present invention in order to realise an essentially single-phase ferritic microstructure in which (coarse) cementite and/or pearlite is suppressed for a good balance between tensile elongation and HEC. Since Mo, like V and Nb, can act as a carbide former, its presence is beneficial as it ties up C to prevent the formation of cementite and/or pearlite and contributes to precipitation strengthening. It is believed that Mo also suppresses coarsening of V- and/or Nb-based composite precipitates and thereby suppresses a reduction in precipitation strengthening caused by coarsening of precipitates during slow coil cooling. The use of Mo depends on the required strength level of the steel sheet or strip and hence is considered as optional in the present invention. In case Mo is used as an alloying element, its content should be at least 0.05 and/or at most 0.7%. A suitable minimum value is 0.10% or even 0.15%. A suitable maximum value is 0.40%, 0.30% or even 0.25%.

Chromium (Cr) provides hardenability and retards the formation of austenite-to-ferrite. As such, it can act—like Mn and Mo—as an effective element to promote acicular/bainitic ferrite at the expense of polygonal ferrite in combination with suitable finish rolling conditions and ROT cooling trajectory. The use of Cr is not mandatory for the present invention. By using suitable levels of Mn and Mo in combination with adequate hot-rolling settings, ROT cooling conditions, and coiling temperature, the desired microstructure together with the required tensile properties, HEC, and/or PEF performance can be achieved. However, the use of Cr may be beneficial to reduce the amount of Mn and/or Mo. Replacing partially Mn with Cr can help to suppress Mn (centre line) segregation, which in turn can reduce the risk of splitting of the steel upon cutting, shearing, or punching. Replacing partially Mo with Cr can help to reduce the Mo content. This is beneficial as Mo can be quite an expensive alloy element. Cr—when used—should be in the range of 0.15 to 1.2%. A suitable minimum content for Cr when used is 0.20% and a suitable maximum content for Cr when used is 1.%.

Nitrogen (N), like C, is a crucial element in the precipitation process. It is known that in particular in combination with precipitation strengthening with V, N is beneficial to promote carbo-nitride precipitates. These carbo-nitride precipitates are less prone to coarsening than carbide precipitates. Hence, elevated levels of N in combination with V can promote additional precipitation strengthening and make a more efficient use of expensive micro-alloy elements, including V and Nb. Since Al is in competition with V for N, it is recommended to use a relatively low Al content when elevated N is used to maximise V precipitation strengthening. In that case, a suitable range for the Al_sol content and N content is 0.005 to 0.04% and 0.006 to 0.02%, respectively. Care should be taken that all N is tied up, either with Al or, preferentially with V. The presence of free N is to be avoided as this will impair formability and fatigue. A suitable maximum N content for the present invention is 0.02%. In case precipitation strengthening in the present invention is to be promoted with predominantly carbide precipitation, an elevated Al_sol content is preferred in between 0.030 and 0.1% and a N content in between 0.002 and 0.01%. A suitable minimum N content for the present invention is 0.002%. A suitable maximum N content is 0.013%.

Calcium (Ca) can be present in the steel and its content will be elevated in case a calcium treatment is used for inclusion control and/or anti-clogging practice to improve casting performance. The use of a calcium treatment is optional in the present invention. If no calcium treatment is used, Ca will be present as an inevitable impurity from the steel making and casting process and its content will typically be at most 0.015%. If a calcium treatment is used, the calcium content of the steel strip or sheet generally does not exceed 100 ppm, and is usually between 5 and 70 ppm. To suppress the amount of composite $Al_xO_y$ inclusions in the final steel, it is preferred not to use a calcium treatment and to give sufficient time during steel making to let inclusions rise out as well as to keep S content at a minimum, preferably at most 0.003%, more preferably at most 0.002%, and most preferably at most 0.001%.

In an embodiment the thickness of the hot-rolled steel sheet or strip produced according to the invention is at least 1.4 mm, and at most 12 mm. Preferably the thickness is at least 1.5 mm and/or at most 5.0 mm. More preferably, the thickness is at least 1.8 mm and/or at most 4.0 mm.

In a preferred embodiment of the invention the hot-rolled steel sheet or strip produced according to the invention comprises C, N, Al_sol, V, and optionally Nb and Mo wherein the contents of these elements (represented by wt %) satisfy the equation of:

$$0.9 \le \left(\frac{\left(\frac{Nb}{93}\right)+\left(\frac{V}{51}\right)+\left(\frac{Mo}{96}\right)}{\left(\frac{C}{12}\right)}\right) \le 2.2 \text{ if } \left(\left[\frac{\text{Al_sol}}{27}\right]-\left(\frac{N}{14}\right)\right) \ge 0$$

In a preferred embodiment of the invention the hot-rolled steel sheet or strip produced according to the invention comprises C, N, Al_sol, V, and optionally Nb and Mo wherein the contents of these elements (represented by wt %) satisfy the equation of:

$$0.9 \le \left(\frac{\left(\frac{Nb}{93}\right)+\left(\frac{V}{51}\right)+\left(\frac{Mo}{96}\right)+\left(\frac{\text{Al_sol}}{27}\right)}{\left(\frac{C}{12}\right)+\left(\frac{N}{14}\right)}\right) \le 2.2 \text{ if } \left(\left[\frac{\text{Al_sol}}{27}\right]-\left(\frac{N}{14}\right)\right) < 0$$

In a preferred embodiment of the invention the hot-rolled steel sheet or strip produced according to the invention has a tensile strength of 570 MPa or higher and comprises C, N, Al_sol, V, and optionally Nb and Mo wherein the contents of these elements (represented by wt %) satisfy the equation of:

$$1.0 \le \left(\frac{\left(\frac{Nb}{93}\right)+\left(\frac{V}{51}\right)+\left(\frac{Mo}{96}\right)+\left(\frac{\text{Al_sol}}{27}\right)}{\left(\frac{C}{12}\right)+\left(\frac{N}{14}\right)}\right) \le 1.5 \text{ if } \left(\left[\frac{\text{Al_sol}}{27}\right]-\left(\frac{N}{14}\right)\right) < 0$$

In a preferred embodiment of the invention the hot-rolled steel sheet or strip produced according to the invention has a tensile strength of 780 MPa or higher and comprises C, N, Al_sol, V, and optionally Nb and Mo wherein the contents of these elements (represented by wt %) satisfy the equation of:

$$1.2 \le \left(\frac{\left(\frac{Nb}{93}\right)+\left(\frac{V}{51}\right)+\left(\frac{Mo}{96}\right)+\left(\frac{\text{Al_sol}}{27}\right)}{\left(\frac{C}{12}\right)+\left(\frac{N}{14}\right)}\right) \le 1.8 \text{ if } \left(\left[\frac{\text{Al_sol}}{27}\right]-\left(\frac{N}{14}\right)\right) < 0$$

In a preferred embodiment of the invention the hot-rolled steel sheet or strip produced according to the invention has a tensile strength of 980 MPa or higher and comprises C, N, Al_sol, V, and optionally Nb and Mo wherein the contents of these elements (represented by wt %) satisfy the equation of:

$$0.9 \leq \left( \frac{\left(\frac{Nb}{93}\right)+\left(\frac{V}{51}\right)+\left(\frac{Mo}{96}\right)+\left(\frac{\text{Al_sol}}{27}\right)}{\left(\frac{C}{12}\right)+\left(\frac{N}{14}\right)} \right) \leq 1.5 \text{ if } \left(\left[\frac{\text{Al_sol}}{27}\right]-\left(\frac{N}{14}\right)\right) < 0$$

In a preferred embodiment of the invention the hot-rolled steel sheet or strip produced according to the invention has a tensile strength of 980 MPa or higher and comprises C, N, Al_sol, V, and optionally Nb and Mo wherein the contents of these elements (represented by wt %) satisfy the equation of:

$$1.0 \leq \left( \frac{\left(\frac{Nb}{93}\right)+\left(\frac{V}{51}\right)+\left(\frac{Mo}{96}\right)}{\left(\frac{C}{12}\right)} \right) \leq 1.5 \text{ if } \left(\left[\frac{\text{Al_sol}}{27}\right]-\left(\frac{N}{14}\right)\right) \geq 0$$

According to another aspect, the invention is also embodied in the manufacturing of the high-strength hot-rolled steel sheet or strip produced according to the invention, wherein the high-strength hot-rolled steel sheet or strip has:

- a tensile strength of at least 570 MPa and a HEC of 90% or higher, or
- a tensile strength of at least 780 MPa and a HEC of 65% or higher, or
- a tensile strength of at least 980 MPa and a HEC of 40% or higher, and wherein $(Rm \times A50)/t^{0.2} > 10000$ or preferably $(Rm \times A50)/t^{0.2} \geq 12000$.

According to another aspect, the invention is also embodied in the manufacturing of the high-strength hot-rolled steel sheet or strip produced according to the invention, wherein the high-strength hot-rolled steel sheet or strip has:

- a tensile strength of at least 570 MPa and a HEC of 90% or higher, and in which the maximum fatigue stress is at least 280 MPa, preferably at least 300 MPa, at $1 \times 10^5$ cycles to failure with a stress ratio of 0.1 and a punching clearance of 8 to 15%, or;
- a tensile strength of at least 780 MPa and a HEC of 65% or higher, and in which the maximum fatigue stress is at least 300 MPa, preferably at least 320 MPa, at $1 \times 10^5$ cycles to failure with a stress ratio of 0.1 and a punching clearance of 8 to 15%, or;
- a tensile strength of at least 980 MPa and a HEC of 40% or higher, and in which the maximum fatigue stress is at least 320 MPa, preferably at least 340 MPa, at $1 \times 10^5$ cycles to failure with a stress ratio of 0.1 and a punching clearance of 8 to 15%;

and wherein $(Rm \times A50)/t^{0.2} > 10000$ or preferably $(Rm \times A50)/t^{0.2} \geq 12000$.

The invention will be now be further explained by means of the following non-limitative examples.

EXAMPLE 1

Steels A to F having the chemical compositions shown in Table 1, were hot rolled under the conditions given in Table 2, producing steels 1A to 38F with a thickness (t) in the range of 2.8 to 4.1 mm. Apart from the chemical composition, Table 1 also provides an indication for Ar3, i.e., the temperature at which the austenite-to-ferrite transformation upon cooling of the steel initiates and ferrite starts to form. As an indicative measure for Ar3 the following equation is used:

$$Ar_3 = 902 - (527 \times C) - (62 \times Mn) + (60 \times Si)$$

Table 2 provides details about the process conditions ($T_{int,ROT}$=Intermediate Run-Out-Table Temperature; $\Delta t_1$=Time between exit finishing mill and start primary cooling on the ROT to $T_{int,ROT}$; $CR_1$=Primary Cooling Rate), the parameters describing the secondary cooling on the ROT ($\Delta t_2$=Time of secondary cooling on the ROT to the coiling temperature (CT); $CR_2$=Secondary Cooling Rate). $CR_{av}$ is the average cooling rate from FRT to CT. The hot-rolled steels were all pickled prior to tensile testing and HEC testing. The reported tensile properties of steels 1A to 38F in Table 3 are based on A50 tensile geometry with tensile testing parallel to the rolling direction according to EN-ISO 6892-1 (2009) (Rp0.2=0.2% offset proof or yield strength; Rm=ultimate tensile strength; YR=yield ratio ($Rp_{0.2}$/Rm); Ag=uniform elongation; A50=A50 tensile elongation; ReH=upper proof or yield strength; ReL=lower proof or yield strength; Ae=yield point elongation).

The product of Rm and tensile elongation (A50 in the present case), Rm×A50, is regarded as a measure for the degree to which steel can absorb energy when it is deformed. This parameter is of relevance for manufacturing when the steel sheet is cold-formed to produce a particular automotive chassis component or the like and to assess its resistance to fracture and subsequent failure during cold-forming. Since the tensile elongation depends partially on the thickness (t) of the steel sheet or strip and is proportional to $t^{0.2}$ according to Oliver's equation, the measure to absorb energy by a steel sheet or strip is can also be expressed as $(Rm \times A50)/t^{0.2}$ to allow a direct comparison between steel sheets or strip with different thickness.

To determine the HEC (λ), which is considered to be a criterion for the degree of SFF, three square samples (90×90 $mm^2$) were cut out from each steel sheet, followed by punching a hole of 10 mm in diameter ($d_0$) in the centre of the steel sample. HEC testing of the samples was done with burr upwards. A conical punch of 60° was pushed up from below and the hole diameter $d_r$ was measured when a through-thickness crack formed. The HEC (λ) was calculated using the formula below with do equals 10 mm:

$$\lambda = \left(\frac{d_f - d_0}{d_0}\right) \times 100\%$$

The HEC of sheets 1A to 38F are reported in Table 3.

The microstructures of steel sheets 1A to 38F were characterised with Electron BackScatter Diffraction (EBSD) to identify the prevalent character of the microstructure and to determine its phase constituents and fractions. To this purpose, the following procedures were followed with respect to sample preparation, EBSD data collection, and EBSD data evaluation.

The EBSD measurements were conducted on cross sections parallel to the rolling direction (RD-ND plane) mounted in a conductive resin and mechanically polished to 1 μm. To obtain a fully deformation-free surface, the final polishing step was conducted with colloidal silica (OPS).

The Scanning Electron Microscope (SEM) used for the EBSD measurements was a Zeiss Ultra 55 machine equipped with a Field Emission GUN (FEG-SEM) and an EDAX PEGASUS XM 4 HIKARI EBSD system. EBSD scans were collected on the RD-ND plane of the steel sheets. The samples were placed under a 70° angle in the SEM. The acceleration voltage was 15 kV with the high current option switched on. A 120 μm aperture was used and the working distance was 17 mm during scanning. To compensate for the high tilt angle of the sample, the dynamic focus correction was used during scanning.

The EBSD scans were captured using the TexSEM Laboratories (TSL) software OIM (Orientation Imaging Microscopy) Data Collection version 7.0.1. Typically, the following data collection settings were used: Hikari camera at 6×6 binning combined with standard background subtraction. The scan area was in all cases located at a position of ¼ of the sample thickness.

The EBSD scan size was in all cases 100×100 μm, with a step size of 0.1 μm, and a scan rate of 80 frames per second. For all steel samples 1A to 38F, no RA was identified in the microstructure and hence, only Fe(α) was included during scanning. The Hough settings used during data collections were: Binned pattern size of circa 96; theta set size of 1; rho fraction of circa 90; maximum peak count of 13; minimum peak count of 5; Hough type set to classic; Hough resolution set to low; butterfly convolution mask of 9×9; peak symmetry of 0.5; minimum peak magnitude of 5; maximum peak distance of 15.

The EBSD scans were evaluated with TSL OIM Analysis software version 7.1.0.×64. Typically, the data sets were 90° rotated over the RD axis to get the scans in the proper orientation with respect to the measurement orientation. A standard grain dilation clean-up was performed (Grain Tolerance Angle (GTA) of 5°, a minimum grain size of 5 pixels, criterion used that a grain must contain multiple rows for a single dilation iteration clean up).

The MisOrientation angle Distribution (MOD) index of the Fe(α) partition was calculated using the following method: the normalised misorientation angle distribution (MOD), including all boundaries, ranging from misorientation angles of 5° to 65° with a binning of 1°, was calculated from the partitioned EBSD data set using the TSL OIM Analysis software. Similarly, the normalised theoretically MOD of randomly recrystallized polygonal ferrite (PF) was calculated with the same misorientation angle range and binning as the measured curve. In practice this is the so-called "MacKenzie" based MOD included in the TSL OIM Analysis software. Normalisation of the MOD means that the area below the MOD is defined as 1. The MOD index is then defined as the area between the theoretical curve (the dashed line) and the measured curve (the solid line) in FIG. 2*a* (top figure) and 2*b* (bottom figure)—and can be defined as:

$$\text{MOD index} = \sum_{i=5}^{65} |R_{MOD,i} - M_{MOD,i}|$$

with $M_{MOD,i}$ as the intensity at angle i (ranging from 5° to 65°) of the measured MOD and $R_{MOD,i}$ as the intensity at angle i of the theoretical or "MacKenzie" based MOD of randomly recrystallized PF.

Figure 2A:
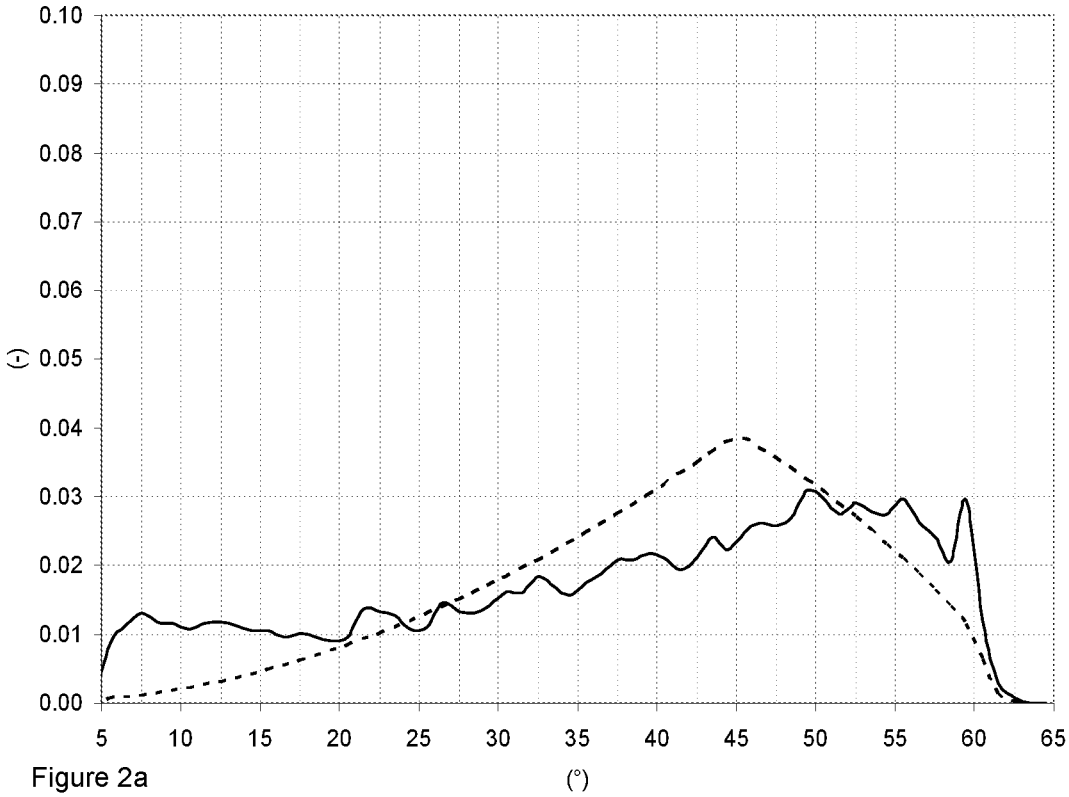
FIG. 2*a* shows a MOD curve for an exemplary sample with a microstructure having a predominantly polygonal ferrite (PF) character.
Figure 2B:
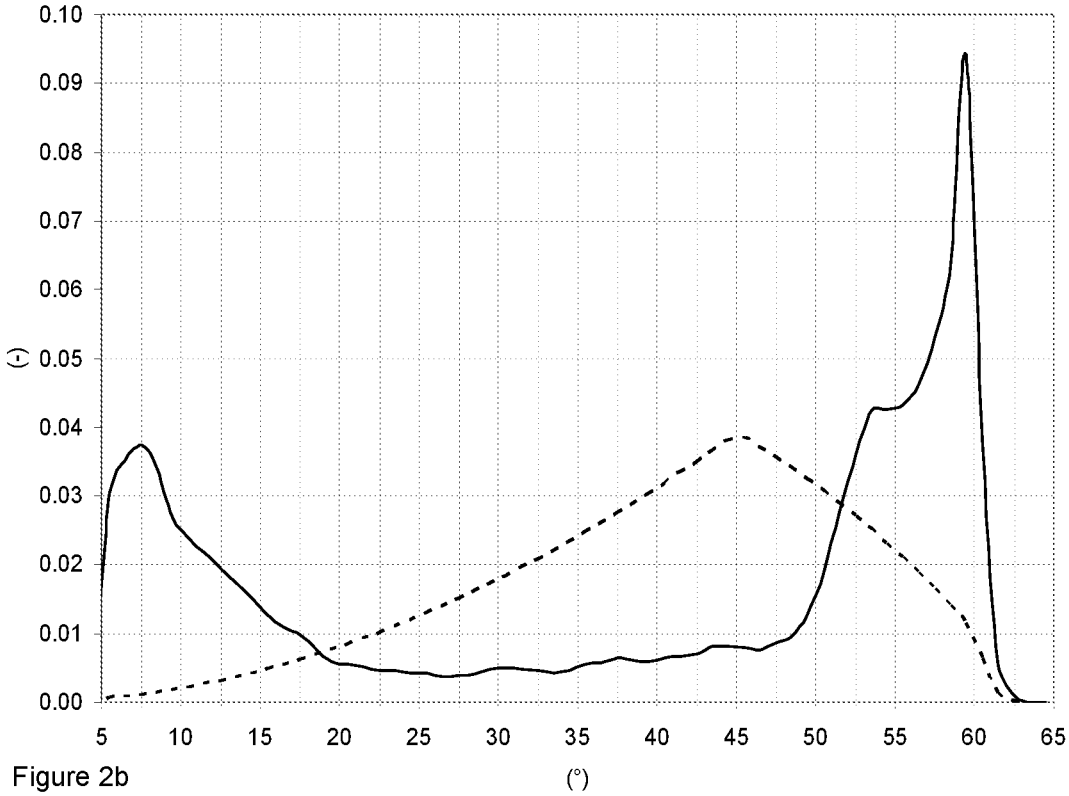
FIG. 2*b* shows a MOD curve of an exemplary sample with a microstructure having a predominantly acicular/bainitic (AF/BF) character.

The solid line in FIGS. 2*a* and 2*b* represents the measured MOD and the dashed curve represents the theoretical misorientation angle curve for a randomly recrystallized polygonal ferrite (PF) structure. FIG. 2*a* shows a MOD curve for an exemplary sample with a microstructure having a predominantly polygonal ferrite (PF) character. FIG. 2*b* shows a MOD curve of an exemplary sample with a microstructure having a predominantly acicular/bainitic (AF/BF) character. The MOD index ranges by definition from 0 to almost 2; when the measured curve is equal to the theoretical curve, the areas between the two curves is 0 (MOD index will be 0), whereas if there is (almost) no intensity overlap between the two distribution curves, the MOD index is (almost) 2. So, as illustrated in FIG. 2*a* and FIG. 2*b*, the MOD contains information on the nature of the microstructure and the MOD index can be used to assess the character of a microstructure based on a quantitative and hence more unambiguous approach than based on conventional methods such as light-optical microscopy. A fully PF microstructure will have a unimodal MOD with most of the intensity in the 20° to 50° range and a peak intensity around 45°. In contrast, a fully AF/BF microstructure will have a strong bimodal MOD with peak intensities in between 5° to 10° and 50° to 60° and little intensity in the range of 20° to 50°. Hence, a low MOD index and a high 20° to 50° MOD intensity in the present example is a clear signature of a predominantly PF microstructure, whereas a high MOD index and a low 20° to 50° MOD intensity is a clear signature of a predominantly AF/BF microstructure.

Figure 3:
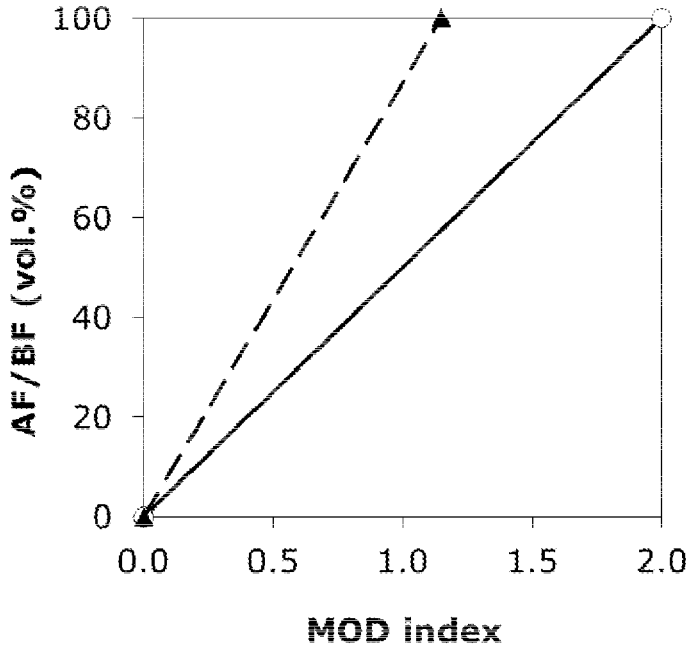
FIG. 3 shows a graph with the volume fraction AF/BF (vol.%) plotted against the MOD index.

Apart from a qualitative assessment of the character of the matrix in terms of acicular/bainitic ferrite (AF/BF) versus polygonal ferrite (PF), the MOD index was also used to determine quantitatively the volume fractions of PF and AF/BF. FIG. 3 shows a graph with the volume fraction AF/BF (vol. %) plotted against the MOD index, in which a linear relationship between volume fraction AF/BF and MOD index is assumed. The solid black line with open circles at 0 and 100% AF/BF illustrates the theoretical relationship of the amount of AF/BF as a function of the MOD index. However, the inventors have found that a microstructure with a MOD index in the range of 1.1 to 1.2 can already be classified based on light-optical microscopy as exclusively or 100% AF/BF. Hence, in the present example, a more empirical relationship between the volume fraction AF/BF and MOD index was found where a 100% PF type of microstructure has a MOD index of 0 and a 100% AF/BF type of microstructure has a MOD index of 1.15. This relationship is illustrated with the dashed line in FIG. 3 with closed triangle symbols at 0 and 100% AF/BF and is given by:

$$AF/BF = 86.96 \times \text{MOD index}$$

In the present case, the amount of PF is assumed to be:

$$PF = 100 - AF/BF$$

with AF/BF and PF expressed in volume percent of the overall microstructure. The EBSD procedure as described here was used to quantify the AF/BF and PF volume fractions of the microstructures of steel sheets 1A to 38F. The MOD index and PF and AF/BF volume fractions are given in Table 3, together with the tensile properties and the HEC of steel sheets 1A to 38F and the average grain size based on EBSD analysis. Based on light-optical microscopy and EBSD observations, the inventors found that in all cases, the overall microstructures of steel sheets 1A to 38F were substantially single-phase ferritic, consisting of polygonal ferrite (PF) and/or acicular/bainitic ferrite (AF/BF) and wherein the total volume fraction of the sum of aforementioned ferritic phase constituents was not lower than 95%. Conventional light-optical microscopy revealed that in all cases the volume fraction of cementite and/or pearlite was lower than 5%.

Steel sheets 1A to 6A and 7B to 14B correspond with a NbVMo- and NbV-based chemistry, respectively, and were in all cases produced with a calcium treatment.

The predicted Ar3 for steel sheets 1A to 14B is circa 775° C. With FRT for these steel sheets of 890 to 910° C., all steel sheets were produced according to the process conditions put forward in EP12167140 and EP13154825 for a NbVMo- or NbV-based alloy, respectively. The same holds for the average cooling rate on the ROT and the coiling temperature used to produce steel sheets 1A to 14B. The average cooling rate and coiling temperature for steel sheets 1A to 14B was in the range of 13 to 17° C./s and 615 to 670° C., respectively.

However, looking at first instance at the tensile properties and hole-expansion capacities of steel sheets 1A to 6A, it is clear that a NbVMo-based alloy like steel A in combination with a substantially single-phase ferritic microstructure does not lead to the desired combination of a minimum tensile strength of 580 MPa and HEC of 90%, or 750 MPa and 60% respectively, or 980 MPa and 30%, respectively.

The microstructures of steel sheets 1A to 14B are all substantially single-phase ferritic, i.e., the amount of cementite and/or pearlite for steel sheets 1A to 14B is at most 3 vol. % or less. However, the HEC of steel sheets 1A to 14B is lacking in comparison to the accompanying tensile strength levels.

To manufacture steel sheets 15C to 22C, another approach was taken. No calcium treatment was used to suppress the amount of $Al_xO_y$-based inclusions in the steel. Furthermore, the hot-rolling and ROT cooling conditions were modified. Instead of $T_{in,FT7}$ and FRT in the range of 930 to 940° C. and 890 to 910° C., respectively, for steel sheets 1A to 14B, considerably higher temperatures were used to produce steel sheets 15C to 22C. For these steel sheets, $T_{in,FT7}$ and FRT were in the range of 990 to 1010° C. and 960 to 990° C., respectively. Apart from a modification in the final rolling conditions, the cooling trajectory on the ROT was changed. For steel sheets 15C to 22C, the cooling rate at the start of the ROT was considerably higher than that used for steels sheets 1A to 14B. Instead of relatively mild cooling in the range of 20 to 35° C./s for circa 8 to 10 seconds as used for steel sheets 1A to 14B, steel sheets 15C to 22C were subjected to much more intense cooling with a cooling rate in the range of 60 to 80° C./s for circa 4 to 5 seconds. For all steels, i.e., 1A to 22C, the initial cooling to an intermediate temperature on the ROT in the range of 640 to 700° C., was followed by further, relatively mild cooling to the final coiling temperature in between 610 to 670° C.

Similar to steel sheets 1A to 14B, the microstructures of steel sheets 15C to 22C were all substantially single-phase ferritic with at most 3 vol. % or less cementite and/or pearlite. However, EBSD analyses revealed that the MOD index associated with the microstructures steels sheets 15C to 22C is significantly higher than that of steels sheets 1A to 14B. Whereas the MOD index of steel sheets 1A to 14B is in the range of 0.2 to 0.44, steels sheets 15C to 22C have MOD index values in between 0.5 to 0.8. The substantially higher MOD index of steel sheets 15C to 22C reveals that the MOD has a significantly different signature and that part of the ferrite morphology of steels sheets 15C to 22C is essentially different from that of steel sheets 1A to 14B. As discussed already, the increased MOD index is a reflection of an increased fraction of acicular/bainitic ferrite in the overall ferritic microstructure at the expense of polygonal ferrite. Based on the MOD index, the volume fraction of polygonal ferrite (PF) for steel sheets 15C to 22C is estimated to be in the range of circa and 35 to 56%, whereas the PF fraction of steel sheets 1A to 14B is estimated to be significantly higher with values in the range of 62 to 80%. Comparing the fraction AF/BF for steels sheets 15C to 22C with that of steels sheets 1A to 14B shows that the former contain circa 44 to 65% AF/BF, whereas for the latter this is in the range 20 to 38%.

The analyses above illustrate that the increased temperatures for the final part of finish rolling as well as the increased cooling rate at the start of the ROT, lead to a change in the mixture of PF and AF/BF and promote the formation of AF/BF at the expense of PF. This in turn has a highly beneficial influence on the HEC without any major effect for yield and tensile strength or tensile elongation. The HEC values measured for steel sheets 15C to 22C are much than those of steel sheets 1A to 14B with similar tensile strength. Whereas the HEC of steel sheets with tensile strength of 780 MPa or higher from the collective of 1A to 14B is in the range of 35 to 60%, the HEC of steel sheets with tensile strength of 780 MPa or higher from the collective of 15C to 22C is in the range of 75 to 100%.

A comparison of the HEC performance and microstructures of steel sheets 23D to 28D on the one hand and 29D on the other shows that it is not only the calcium treatment that can play a role, but foremost the hot-rolling and ROT cooling conditions. For all steel sheets 23D to 29D no calcium treatment was used and the only difference between steel sheets 23D to 28D on the one hand and 29D on the other are the hot-rolling and ROT cooling conditions used. For steel sheets 23D to 28D $T_{in,FT7}$ and FRT were in the range of 920 to 970° C. and 900 and 940° C., respectively, whereas for steel sheet 29D this was considerably higher with values of 1000 and 963° C., respectively. Also, the cooling rate at the start of the ROT was considerably higher for steel sheets 29D: circa 71° C./s for 29D versus 27 to 44° C./s for steel sheets 23D to 28D. Although the microstructures of all steel sheets 23D to 29D are substantially single-phase ferritic, the increased temperatures for finish rolling in combination with increased cooling of the steel strip at the start of the ROT used for steel sheet 29D, leads to an increase in the fraction of acicular/bainitic ferrite at the expensive of polygonal ferrite and leads to a substantial increase in HEC without compromising significantly the tensile properties. This is reflected in the measured MOD index values, i.e., steel sheets 23d to 28D have MOD index values in the range of 0.30 to 0.45, whereas that for steel sheet 29D is considerably higher with a value of 0.65. With regard to hole-expansion capacity, the values for steels sheets 23D to 28D are in the range of 35 to 53%, whereas as the HEC of steel sheet 29D is 81%.

Also for steel E—steels sheets 30E to 36E—the influence of hot-rolling and ROT cooling conditions on tensile properties, hole-expansion capacity, and microstructure was investigated. The influence seen for steel E is similar to that observed with regard to HEC and microstructure for steel sheets 23D to 28D versus steel sheet 29D: an increase in the finish rolling temperature and the initial cooling rate at the start of the ROT leads to a substantial increase in HEC and in a change in the volume fractions of PF and AF/BF in the overall substantially single-phase ferritic microstructure. The latter is again reflected in an increase of the MOD index, i.e., steel sheets 30E to 35E have MOD index values in the range of 0.25 to 0.42, whereas for steel sheet 36E this is circa 0.50. The corresponding HEC for steels sheets 30E to 35E is in the range of 35 to 56%, whereas that of steel sheet 36E is substantially higher with a measured value of 65%.

Whereas the HEC as a measure for the SFF has a bearing on the manufacturability of an automotive chassis component out of a particular steel sheet, the PEF is considered as a measure for the critical edge fatigue of an automotive chassis component once in service. To determine the PEF, rectangular samples (185×45 $mm^2$) with the longitudinal axis parallel to rolling direction were cut out from a number of steel sheet, followed by punching (single-punching) a hole of 15 mm in diameter in the centre of the steel sample. The geometry of these PEF samples was designed so that the stress concentration in the circumference of the hole is large enough to ensure that the fatigue crack always initiates next to the hole. This meant that the rectangular samples could be simply cut out with guillotine shears without the necessity for further sanding/polishing as is normally the case with regular substrate stress-life or S—N fatigue testing (Stress (in MPa) as a function of cycles to failure (Nf)). The investigated steels sheets were all punched with a 15 mm punch. Steel sheets 6A and 15C, with a thickness of circa 3.05 and 3.04 mm, respectively, were punched in combination with a 15.8 mm die, leading to a clearance of 13.1 to 13.2%, respectively, for these steel sheets. For steel sheet 29D, with a thickness of 2.89 mm, a 15.5 mm die was used, which lead to a clearance of 8.7%. The clearance (Cl in percent) is calculated based on the diameter of the die ($d_{die}$ in mm), and diameter of the punch ($d_{punch}$, in this case 15 mm), and the thickness (t in mm) of the steel sheet according to:

$$Cl = \left( \frac{\frac{1}{2} \times (d_{die} - d_{punch})}{t} \right) \times 100\%$$

All PEF tests were carried out with an hydraulic uniaxial test machine and a testing R-value (minimum load/maximum load) of 0.1. The loads were converted to stresses in order to remove the influence of material thickness by dividing the test load by the cross sectional area at the middle of the punched-hole fatigue test sample (i.e., sample width minus the measured size of the hole). The failure criterion used for the PEF testing was a 0.1 mm increase in displacement.

The results of the PEF testing are shown in Table 4 together with an indication of process conditions (Ca=calcium treatment, yes or no; HSM=finish rolling temperatures, ROT cooling conditions, and coiling temperature in agreement with the present invention, yes or no), tensile properties (Rp0.2=0.2% offset proof or yield strength; Rm=ultimate tensile strength; A50=A50 tensile elongation), HEC (λ), and microstructural characteristics (PF=volume fraction polygonal ferrite; AF/BF=volume fraction acicular/bainitic ferrite; MOD index). Relevant features to describe the PEF strength in Table 4 are the maximum fatigue stress ($\sigma_{max}$) and the ratio (in percent) of maximum fatigue stress ($\sigma_{max}$) over Rm at $1\times10^5$ cycles for a particular clearance (Cl) used to punch the steel sheet. Also presented in Table 4 is an optical assessment of the amount of splitting when the steel substrate is punched. The degree of splitting is expressed in percent of the circumference of the punched hole.

In general, the PEF performance of a steel is largely governed by the surface roughness of the fracture zone of the punched edge and the amount of strain and damage accumulated in the interior of the steel sheet close to the punched edge. These features in turn are partially determined by the microstructure and mechanical response of the steel substrate as well as by the influence of punching conditions, including—in particular—the clearance between the punch and the die. It is known that an increase in the clearance is likely to be accompanied by an increase in the roughness of the fracture zone, which in turn can lead to a deterioration of the PEF. Furthermore, as the clearance is increased, the amount of strain and—in particular—internal damage due to the presence of (centre line) segregation and/or inclusions can increase. This internal damage can lead to splitting, internal voids and potentially internal micro-cracks inside the steel substrate, which all can act as local stress raisers during cyclic fatigue loading and hence can impair PEF performance.

Figure 4:
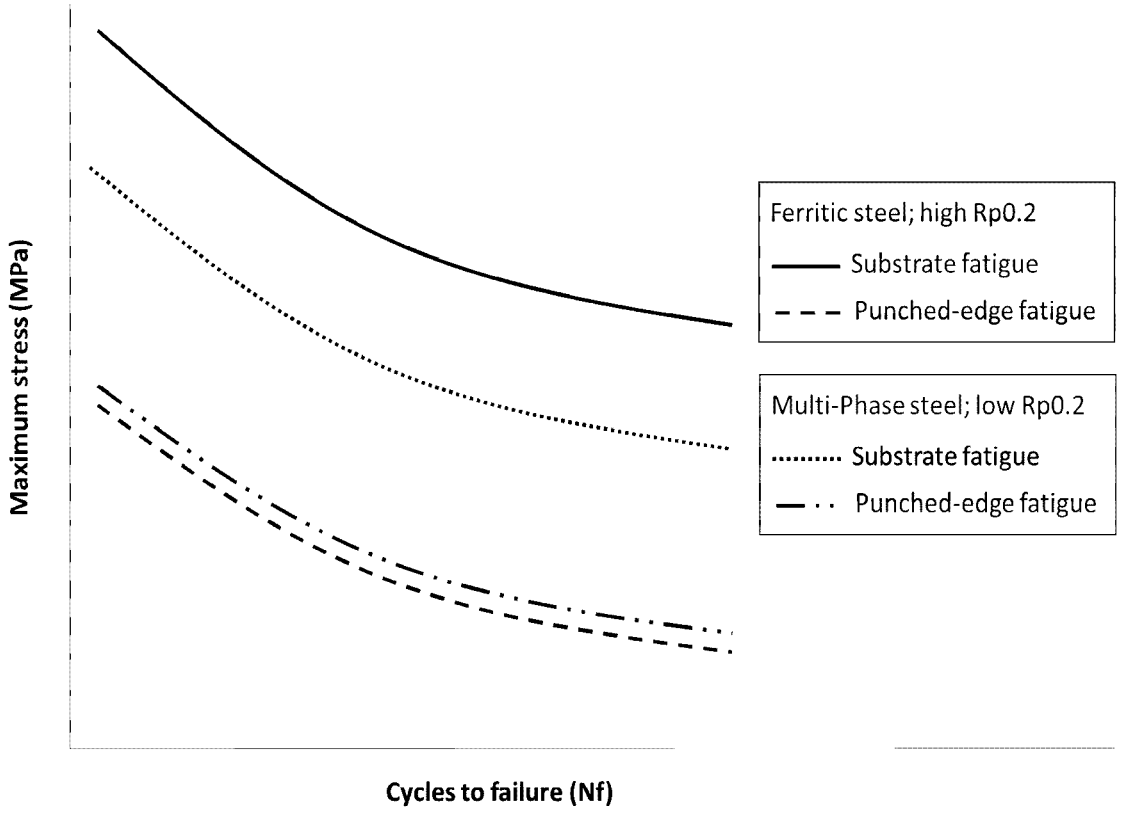
FIG. 4 shows a schematic graph, illustrating the influence of the yield strength (Rp0.2) on the substrate S-N fatigue as well as on the PEF.

FIG. 4 shows a schematic graph, illustrating the influence of the yield strength (Rp0.2) on the substrate S—N fatigue as well as on the PEF for a ferritic steel and a multi-phase steel with identical tensile strength and punched with similar clearance, albeit that both steels have a significantly different yield strength. As known, ferritic steels, such as conventional HSLA steels but also the single-phase precipitation-strengthened steel as defined in the present invention have a relatively high yield strength with a typical yield ratio in the range of 0.85 to almost 1. In contrast, multi-phase steels like dual-phase (DP) or a complex phase (CP) steels typically have a considerably lower yield strength and a yield ratio typically in the range of 0.5 to 0.85. The general rule is that a steel with a high yield strength will have a substantially higher substrate S—N fatigue strength than a steel with a low yield strength. In case of substrate S—N fatigue, the fatigue strength is governed by nucleation and growth of the fatigue fracture during cyclic loading, which is largely controlled by surface roughness of the steel sheet and microstructure, respectively.

However, once the steel sheet is punched, the S—N fatigue performance is largely controlled by the punched hole as stress concentration in the circumference of the hole is likely to be larger than anywhere else in the steel sheet. In turn, this will lead to fatigue crack nucleation and growth next to the hole in the steel sheet.

As illustrated in FIG. 4, punching a steel sheets leads to a substantial drop in stress-life (S—N) fatigue performance. A steel with a high yield strength will typically experience a substantially higher reduction in fatigue performance once the steel sheet is punched than a steel with a relatively low yield strength. The consequence of this is illustrated in FIG. 4, highlighting that upon punching the stress-life fatigue curves of ferritic and multi-phase steel grades almost seem to collide and that—in contrast to the conventional stress-life substrate fatigue—the yield stress no longer dictates the order of the curves. Instead, other factors, like the condition of the punched edge, i.e., the surface roughness of the fracture zone, and the strain and damage interior in the steel sheet close to the punched-edge wall will dictate the position of the stress-life PEF curve. Hence, it is crucial to ensure that the PEF of targeted high-strength steels is sufficiently high to warrant any down-gauging potential without loss in performance.

It was already shown in Tables 2 and 3 that the nano-precipitation strengthened single-phase ferritic steel of the present invention is able to accommodate high strength combined with high tensile elongation and high hole-expansion capacity. The corresponding microstructure consists of a mixture of polygonal ferrite and acicular/bainitic ferrite. In particular the latter ferrite constituents are believed to be essential to promote excellent hole-expansion capacity. The earlier comparative examples show that a too high fraction of polygonal ferrite at the expense of acicular/bainitic ferrite leads to too low HEC and hence to premature fracture and failure once a punched hole is stretched. In that context, the acicular/bainitic phase constituents required for the present invention are believed to increase the damage resistance of the steel sheet when subjected to intense local deformation as is the case when the steel sheet is punched, cut, or sheared. In particular acicular ferrite, which can nucleate on inclusions in the steel, is believed to be capable to embed inclusions locally in a fine-grained matrix, making their presence less harmful when the steel is heavily deformed during punching or the like. Furthermore, the fine and intricate ferrite morphology of the acicular and bainitic ferrite phase constituents is believed to suppress fracture propagation. These aspects, together with preventing or at least suppressing any (centre line) segregation which may lead to splitting upon punching, and preventing or at least suppressing the presence of sulphide- and/or oxide-based inclusions (i.e., inclusions with a diameter of 1 μm or larger) in the final microstructure, are of relevance to ensure that the reduction in fatigue performance for the nano-precipitation strengthened single-phase ferritic steel of the present invention is kept to a minimum. In this context, a low S content, optionally in combination with avoiding a calcium treatment during steel making and trying to promote that $Al_xO_y$-based inclusions are given sufficient time to rise out of the liquid steel, is beneficial to reduce the amount of sulphide- and/or oxide-based inclusions. Also, it is beneficial for the present invention to arrange steel making and casting in such a way that segregation, and in particular centre line segregation is suppressed or even completely be prevented.

Table 4 shows the PEF performance and punch-die clearance used for a comparative and two inventive examples for the present invention, together with an indication of relevant process conditions and information on corresponding tensile properties, hole-expansion capacity, clearance, as well as microstructural characteristics derived from EBSD analyses and an assessment of the degree of splitting upon punching. The PEF performance is measured here as the maximum fatigue strength $\sigma_{max}$ at $1\times10^5$ cycles to failure expressed in MPa and as the ratio (in percent) of maximum fatigue stress ($\sigma_{max}$) over Rm at $1\times10^5$ cycles for a particular clearance (Cl) used to punch the steel sheet. Clearances used for the steel sheets shown Table 4 are circa 13% for steel sheets 6A and 15C and 8.7% for inventive steel sheet 29D.

The data shows that the PEF as expressed by the maximum fatigue strength $\sigma_{max}$ at $1\times10^5$ cycles to failure for comparative steel sheet 6A is 296 MPa, whereas that for inventive steel sheet 15C with practical identical thickness and clearance used for punching is substantially higher with a value of 314 MPa. The same trend holds for the ratio of $\sigma_{max}$/Rm at $1\times10^5$ cycles to failure for comparative steel sheet 6A and inventive steel sheet 15C, i.e., 35.2% versus 37.8%, respectively. The improved PEF performance of steel sheet 15C over 6A is attributed—in analogy to that discussed earlier in relation to HEC—to the fact that the S content was kept low, no calcium treatment was used and the fact that the finish rolling, ROT and coiling conditions were in line with the present invention, leading to the desired microstructure consisting of a mixture of polygonal ferrite and acicular/bainitic ferrite with at most 60% PF and at least 40% of AF/BF in the case of steel sheet 15C. Another striking observation is that for comparative steel sheet 6A extensive splitting was observed, covering 80 to 100% of the circumference of the punched hole. For inventive steel sheet 15C the degree of splitting was at most 5% after punching. The strong reduction in splitting is associated with a strong decrease in the amount of centre line segregation and a reduction in the amount of relatively large $Al_xO_y$-based inclusions for inventive steel sheet 15C compared to comparative steel sheet 6A.

Table 4 also shows details regarding inventive example 29D. To evaluate the PEF performance of this steel sheet, a clearance of 8.7% was used. Also this steel sheet showed little or no evidence of splitting upon punching and delivered a good PEF strength at $1\times10^5$ cycles to failure of 331 MPa based on the desired microstructure of a mixture of polygonal ferrite and acicular/bainitic ferrite with—in this particular inventive case—at most 50% PF and at least 50% of AF/BF.

TABLE 1

Composition of steels.

| | Chemical composition (in 1/1000 wt %, Ca & N (in ppm)) | | | | | | | | | | | $A_{r3}$ | Atomic Ratio | |
|---|---|---|---|---|---|---|---|---|---|---|---|---|---|---|
| Steel | C | Mn | Si | P | S | Al_sol | Nb | V | Mo | Ca | N | (° C.) | A | B |
| A | 46 | 1698 | 18 | 16 | 2 | 32 | 58 | 215 | 148 | 18 | 146 | 774 | 1.665 | 0.319 |
| B | 38 | 1793 | 94 | 10 | 3 | 33 | 31 | 238 | 4 | 24 | 149 | 776 | 1.592 | 0.008 |
| C | 57 | 1427 | 196 | 10 | 2 | 23 | 63 | 221 | 150 | 5 | 107 | 795 | 1.384 | 0.312 |
| D | 57 | 1383 | 194 | 10 | 1 | 24 | 62 | 212 | 149 | 2 | 116 | 798 | 1.342 | 0.322 |
| E | 48 | 1380 | 89 | 11 | 1 | 20 | 60 | 246 | 3 | 2 | 108 | 796 | 1.375 | 0.006 |
| F | 50 | 1379 | 206 | 11 | 1 | 24 | 63 | 216 | 143 | 4 | 103 | 803 | 1.537 | 0.303 |

$$\text{Ratio A:}\left(\frac{\left(\frac{Nb}{93}\right)+\left(\frac{V}{51}\right)+\left(\frac{Mo}{96}\right)}{\left(\frac{C}{12}\right)}\right)\text{ and Ratio B:}\left(\frac{\left(\frac{Mo}{96}\right)}{\left(\frac{Nb}{93}\right)+\left(\frac{V}{51}\right)}\right)$$

with Nb, V, Mo, and C represented by wt %

$A_{r3} = 902 - (527 \times C) - (62 \times Mn) + (60 \times Si)$ with C, Mn, and Si represented by wt %

Ar3 is defined as the temperature at which the austenite-to-ferrite transformation upon cooling of the steel initiates and ferrite starts to form.

TABLE 2

Process conditions of steels.

| | | | Hot-rolling conditions | | | | | | | | | | | |
|---|---|---|---|---|---|---|---|---|---|---|---|---|---|---|
| Sheet | Steel | t (mm) | RHT (° C.) | $T_{in,FT1}$ (° C.) | $T_{in,FT7}$ (° C.) | FRT (° C.) | $\Delta t_1$ (s) | $CR_1$ (° C./s) | $T_{int,ROT}$ (° C.) | $\Delta t_2$ (s) | $CR_2$ (° C./s) | CT (° C.) | $CR_{av}$ (° C./s) | Example |
| 1 | A | 3.53 | 1227 | 1029 | 932 | 908 | 9.0 | 26.9 | 667 | 8.1 | 2.2 | 649 | 15.2 | Comparative |
| 2 | A | 3.53 | 1216 | 1021 | 931 | 908 | 9.0 | 27.9 | 657 | 8.1 | 2.6 | 636 | 15.9 | Comparative |
| 3 | A | 3.53 | 1224 | 1026 | 936 | 899 | 9.0 | 26.9 | 657 | 8.1 | 2.6 | 636 | 15.4 | Comparative |
| 4 | A | 3.53 | 1212 | 1017 | 931 | 908 | 9.0 | 28.3 | 653 | 8.1 | 3.3 | 626 | 16.5 | Comparative |
| 5 | A | 3.53 | 1229 | 1029 | 935 | 898 | 9.0 | 23.8 | 684 | 8.1 | 3.0 | 660 | 13.9 | Comparative |
| 6 | A | 3.05 | 1218 | 1027 | 938 | 906 | 8.2 | 31.4 | 649 | 7.4 | 3.9 | 620 | 18.4 | Comparative |
| 7 | B | 3.51 | 1227 | 1033 | 938 | 902 | 9.0 | 22.8 | 698 | 8.1 | 4.0 | 666 | 13.9 | Comparative |
| 8 | B | 3.51 | 1210 | 1031 | 937 | 903 | 9.0 | 22.8 | 699 | 8.1 | 4.9 | 659 | 14.3 | Comparative |
| 9 | B | 3.51 | 1221 | 1025 | 936 | 905 | 9.0 | 23.7 | 693 | 8.1 | 6.1 | 644 | 15.3 | Comparative |
| 10 | B | 3.51 | 1208 | 1021 | 937 | 906 | 9.0 | 25.1 | 681 | 8.1 | 4.6 | 644 | 15.4 | Comparative |
| 11 | B | 3.51 | 1212 | 1022 | 935 | 903 | 9.0 | 24.3 | 685 | 8.1 | 5.4 | 641 | 15.4 | Comparative |
| 12 | B | 3.51 | 1193 | 1024 | 936 | 904 | 8.7 | 25.0 | 685 | 7.9 | 5.9 | 638 | 15.9 | Comparative |
| 13 | B | 3.51 | 1208 | 1018 | 935 | 906 | 9.0 | 26.3 | 671 | 8.1 | 6.4 | 619 | 16.9 | Comparative |
| 14 | B | 3.51 | 1206 | 1018 | 933 | 904 | 9.0 | 26.2 | 670 | 8.1 | 6.2 | 620 | 16.7 | Comparative |
| 15 | C | 3.04 | 1192 | 1028 | 1007 | 961 | 4.4 | 64.1 | 681 | 7.2 | 8.4 | 621 | 29.6 | Inventive |
| 16 | C | 3.04 | 1207 | 1032 | 1000 | 963 | 4.4 | 63.9 | 684 | 7.2 | 9.7 | 615 | 30.2 | Inventive |
| 17 | C | 3.04 | 1224 | 1054 | 1006 | 974 | 4.4 | 65.3 | 689 | 7.2 | 10.4 | 614 | 31.3 | Inventive |
| 18 | C | 3.04 | 1235 | 1062 | 1006 | 977 | 4.4 | 68.3 | 679 | 7.2 | 6.4 | 633 | 29.9 | Inventive |
| 19 | C | 3.04 | 1202 | 1049 | 999 | 974 | 4.4 | 66.6 | 684 | 7.2 | 7.5 | 630 | 29.9 | Inventive |
| 20 | C | 4.03 | 1227 | 1016 | 997 | 978 | 4.4 | 76.4 | 645 | 7.2 | 4.6 | 612 | 31.8 | Inventive |
| 21 | C | 4.03 | 1227 | 1021 | 998 | 985 | 4.4 | 72.8 | 667 | 7.2 | 5.1 | 630 | 30.8 | Inventive |
| 22 | C | 4.03 | 1223 | 1020 | 998 | 966 | 4.4 | 63.6 | 688 | 7.2 | 9.0 | 624 | 29.7 | Inventive |
| 23 | D | 3.83 | 1238 | 1045 | 933 | 908 | 9.0 | 27.2 | 664 | 8.1 | 4.4 | 628 | 16.4 | Comparative |
| 24 | D | 3.83 | 1229 | 1038 | 936 | 913 | 9.0 | 27.1 | 669 | 8.1 | 4.7 | 631 | 16.5 | Comparative |
| 25 | D | 2.89 | 1235 | 975 | 967 | 938 | 6.1 | 43.6 | 674 | 5.5 | 7.9 | 631 | 26.7 | Comparative |
| 26 | D | 2.89 | 1238 | 1048 | 925 | 903 | 7.6 | 30.6 | 671 | 6.8 | 6.3 | 628 | 19.1 | Comparative |
| 27 | D | 2.89 | 1221 | 1036 | 924 | 909 | 7.3 | 32.2 | 672 | 6.6 | 6.2 | 631 | 19.9 | Comparative |
| 28 | D | 2.89 | 1219 | 1035 | 922 | 917 | 8.2 | 37.6 | 684 | 7.3 | 5.7 | 642 | 17.8 | Comparative |
| 29 | D | 2.89 | 1228 | 1066 | 1000 | 963 | 4.4 | 71.4 | 651 | 7.2 | 2.0 | 637 | 28.4 | Inventive |
| 30 | E | 2.89 | 1235 | 990 | 970 | 941 | 6.1 | 48.4 | 693 | 5.4 | 11.4 | 631 | 27.0 | Comparative |
| 31 | E | 2.89 | 1231 | 1003 | 971 | 945 | 6.1 | 50.3 | 725 | 5.5 | 11.2 | 626 | 27.7 | Comparative |
| 32 | E | 2.89 | 1242 | 997 | 941 | 923 | 6.1 | 45.8 | 688 | 5.5 | 10.4 | 631 | 25.4 | Comparative |
| 33 | E | 2.89 | 1238 | 982 | 940 | 926 | 6.1 | 46.0 | 690 | 5.5 | 10.8 | 631 | 25.6 | Comparative |
| 34 | E | 3.83 | 1238 | 1049 | 936 | 906 | 9.0 | 29.9 | 677 | 8.1 | 6.2 | 627 | 16.3 | Comparative |
| 35 | E | 2.89 | 1236 | 1047 | 934 | 912 | 8.0 | 35.3 | 706 | 7.3 | 7.4 | 635 | 18.0 | Comparative |
| 36 | E | 2.89 | 1219 | 1062 | 1001 | 959 | 4.4 | 56.8 | 711 | 7.2 | 4.0 | 645 | 27.2 | Inventive |
| 37 | F | 3.23 | 1227 | 1073 | 1002 | 965 | 4.2 | 81.6 | 623 | 6.8 | −3.2 | 645 | 29.0 | Inventive |
| 38 | F | 3.23 | 1231 | 1059 | 1006 | 976 | 4.4 | 73.6 | 655 | 7.2 | 0.0 | 655 | 27.9 | Inventive |

40

TABLE 3

Tensile and HEC properties of steels and their microstructure.

| | | | Tensile properties (A50 tensile geometry) | | | | | | | | HEC | Microstructure | | | |
|---|---|---|---|---|---|---|---|---|---|---|---|---|---|---|---|
| Sheet | Steel | t (mm) | Rp0.2 (MPa) | Rm (MPa) | YR (—) | Ag (%) | A50 (%) | ReH (MPa) | ReL (MPa) | Ae (%) | λ (%) | PF (%) | AF/BF (%) | MOD index | Example |
| 1 | A | 3.53 | 757 | 822 | 0.92 | 10.6 | 20.3 | 770 | 749 | 1.9 | 53 | 66.6 | 33.4 | 0.384 | Comparative |
| 2 | A | 3.53 | 722 | 827 | 0.87 | 10.3 | 19.9 | 780 | 761 | 2.3 | 58 | 63.9 | 36.1 | 0.415 | Comparative |
| 3 | A | 3.53 | 715 | 777 | 0.92 | 11.9 | 21.6 | 742 | 715 | 2.6 | 52 | 62.5 | 37.5 | 0.431 | Comparative |
| 4 | A | 3.53 | 752 | 837 | 0.90 | 10.5 | 20.0 | 777 | 762 | 1.6 | 35 | 63.1 | 36.9 | 0.425 | Comparative |
| 5 | A | 3.53 | 731 | 798 | 0.92 | 10.6 | 19.3 | 751 | 729 | 3.2 | 48 | 66.2 | 33.8 | 0.388 | Comparative |
| 6 | A | 3.05 | 782 | 842 | 0.93 | 10.5 | 19.4 | 794 | 767 | 1.9 | 58 | 66.9 | 33.1 | 0.381 | Comparative |
| 7 | B | 3.51 | 679 | 739 | 0.92 | 11.0 | 19.7 | 682 | 657 | 2.1 | 67 | 63.0 | 37.0 | 0.425 | Comparative |
| 8 | B | 3.51 | 668 | 723 | 0.92 | 11.2 | 20.6 | 670 | 637 | 2.0 | 71 | 75.9 | 24.1 | 0.277 | Comparative |
| 9 | B | 3.51 | 650 | 732 | 0.89 | 11.4 | 21.3 | 669 | 650 | 2.0 | 76 | 70.1 | 29.9 | 0.344 | Comparative |
| 10 | B | 3.51 | 678 | 762 | 0.89 | 11.0 | 20.5 | 689 | 668 | 2.0 | 49 | 78.6 | 21.4 | 0.246 | Comparative |
| 11 | B | 3.51 | 693 | 770 | 0.90 | 11.2 | 20.7 | 709 | 681 | 2.2 | 47 | 66.7 | 33.3 | 0.383 | Comparative |
| 12 | B | 3.51 | 669 | 755 | 0.89 | 11.4 | 21.5 | 692 | 670 | 0.7 | 59 | 71.2 | 28.8 | 0.332 | Comparative |
| 13 | B | 3.51 | 672 | 762 | 0.88 | 11.7 | 22.1 | 683 | 664 | 1.6 | 47 | 75.5 | 24.5 | 0.282 | Comparative |
| 14 | B | 3.51 | 682 | 770 | 0.89 | 11.4 | 21.4 | 708 | 679 | 2.0 | 53 | 64.1 | 35.9 | 0.413 | Comparative |
| 15 | C | 3.04 | 744 | 830 | 0.90 | 10.1 | 18.6 | continuous yielding | | | 95 | 50.6 | 49.4 | 0.568 | Inventive |
| 16 | C | 3.04 | 702 | 792 | 0.89 | 10.9 | 21.0 | continuous yielding | | | 80 | 48.7 | 51.3 | 0.590 | Inventive |
| 17 | C | 3.04 | 742 | 826 | 0.90 | 10.0 | 19.2 | continuous yielding | | | 83 | 46.2 | 53.8 | 0.618 | Inventive |
| 18 | C | 3.04 | 773 | 853 | 0.91 | 9.5 | 17.9 | continuous yielding | | | 98 | 53.1 | 46.9 | 0.539 | Inventive |
| 19 | C | 3.04 | 759 | 839 | 0.90 | 9.8 | 18.3 | continuous yielding | | | 81 | 55.6 | 44.4 | 0.510 | Inventive |
| 20 | C | 4.03 | 725 | 817 | 0.89 | 9.6 | 19.3 | continuous yielding | | | 81 | 35.9 | 64.1 | 0.737 | Inventive |
| 21 | C | 4.03 | 696 | 803 | 0.87 | 9.9 | 20.0 | continuous yielding | | | 68 | 41.4 | 58.6 | 0.674 | Inventive |

TABLE 3-continued

Tensile and HEC properties of steels and their microstructure.

| | | | Tensile properties (A50 tensile geometry) | | | | | | | | HEC | Microstructure | | | |
|---|---|---|---|---|---|---|---|---|---|---|---|---|---|---|---|
| Sheet | Steel | t (mm) | Rp0.2 (MPa) | Rm (MPa) | YR (—) | Ag (%) | A50 (%) | ReH (MPa) | ReL (MPa) | Ae (%) | λ (%) | PF (%) | AF/BF (%) | MOD index | Example |
| 22 | C | 4.03 | 742 | 829 | 0.90 | 9.7 | 19.6 | continuous yielding | | | 76 | 54.3 | 45.7 | 0.526 | Inventive |
| 23 | D | 3.83 | 762 | 854 | 0.89 | 10.4 | 17.9 | 771 | 766 | 0.3 | 42 | 61.3 | 38.7 | 0.445 | Comparative |
| 24 | D | 3.83 | 766 | 843 | 0.91 | 10.4 | 18.5 | 769 | 759 | 1.0 | 37 | 73.6 | 26.4 | 0.304 | Comparative |
| 25 | D | 2.89 | 746 | 833 | 0.90 | 10.4 | 17.3 | 750 | 743 | 0.2 | 39 | 62.6 | 37.4 | 0.430 | Comparative |
| 26 | D | 2.89 | 736 | 830 | 0.89 | 10.6 | 17.5 | continuous yielding | | | 35 | 70.9 | 29.1 | 0.335 | Comparative |
| 27 | D | 2.89 | 741 | 823 | 0.90 | 11.0 | 18.4 | 744 | 735 | 1.0 | 53 | 70.3 | 29.7 | 0.342 | Comparative |
| 28 | D | 2.89 | 779 | 827 | 0.94 | 10.3 | 17.2 | 779 | 760 | 0.2 | 56 | 65.7 | 34.3 | 0.395 | Comparative |
| 29 | D | 2.89 | 720 | 802 | 0.90 | 9.5 | 16.7 | continuous yielding | | | 81 | 43.6 | 56.4 | 0.650 | Inventive |
| 30 | E | 2.89 | 703 | 807 | 0.87 | 11.1 | 18.5 | continuous yielding | | | 44 | 64.0 | 36.0 | 0.415 | Comparative |
| 31 | E | 2.89 | 692 | 809 | 0.86 | 10.8 | 18.4 | continuous yielding | | | 41 | 63.5 | 36.5 | 0.420 | Comparative |
| 32 | E | 2.89 | 705 | 799 | 0.88 | 11.4 | 18.4 | 705 | 701 | 0.1 | 42 | 63.8 | 36.2 | 0.417 | Comparative |
| 33 | E | 2.89 | 693 | 785 | 0.88 | 11.6 | 19.4 | 694 | 687 | 0.6 | 41 | 63.9 | 36.1 | 0.415 | Comparative |
| 34 | E | 3.83 | 722 | 822 | 0.88 | 10.8 | 18.7 | continuous yielding | | | 36 | 69.1 | 30.9 | 0.355 | Comparative |
| 35 | E | 2.89 | 679 | 747 | 0.91 | 11.1 | 18.0 | 679 | 651 | 2.0 | 46 | 77.7 | 22.3 | 0.257 | Comparative |
| 36 | E | 2.89 | 719 | 820 | 0.88 | 10.3 | 17.7 | continuous yielding | | | 65 | 56.2 | 43.8 | 0.504 | Inventive |
| 37 | F | 3.23 | 737 | 801 | 0.92 | 9.4 | 16.6 | 737 | 728 | 1.2 | 99 | 48.3 | 51.7 | 0.594 | Inventive |
| 38 | F | 3.23 | 710 | 787 | 0.90 | 8.9 | 15.9 | 713 | 709 | 1.4 | 91 | 54.5 | 45.5 | 0.523 | Inventive |

TABLE 4

Tensile and PEF properties of steels and their microstructure.

| | | | | | A50 tensile data | | | HEC | | | PEF (R = −1) | | | Microstructure | | | |
|---|---|---|---|---|---|---|---|---|---|---|---|---|---|---|---|---|---|
| | | t | Process | | | | | | | | $\sigma_{max}$ at $1 \times 10^5$ | $\sigma_{max}$/Rm at $1 \times 10^5$ | | | | | |
| Sheet | Steel | (mm) | Ca | HSM | Rp0.2 (MPa) | Rm (MPa) | A50 (%) | λ (%) | Cl (%) | Split (%) | cycles (MPa) | cycles (%) | PF (%) | AF/BF (%) | MOD index | Examples |
| 6 | A | 3.05 | Yes | No | 782 | 842 | 19.4 | 58 | 13.1 | 80-100 | 296 | 35.2 | 66.9 | 33.1 | 0.381 | Comparative |
| 15 | C | 3.04 | No | Yes | 744 | 830 | 18.6 | 95 | 13.2 | 0-5 | 314 | 37.8 | 50.6 | 49.4 | 0.568 | Inventive |
| 29 | D | 2.89 | No | Yes | 720 | 802 | 16.7 | 81 | 8.7 | 0-5 | 331 | 41.3 | 43.6 | 56.4 | 0.650 | Inventive |

Ca stands for the optional use of a calcium treatment. Indicated in the Table is whether calcium treatment was used (Yes) or not (No).

HSM stands for the followed Hot-Strip Mill (HSM) process settings (see details in Table 2 for the steel sheets presented in Table 4). Indicated in the Table is whether the HSM process conditions were:

in agreement with the present invention (Yes) and hence inventive or;

not in agreement with the present invention (No) and hence comparative.

Split stands for splitting when the steel sheet is punched and the degree of splitting is expressed in percent of the circumference of the punched hole.

The invention claimed is:

1. A method to manufacture a hot-rolled high-strength steel strip with a tensile strength of at least 570 MPa, comprising the steps of:

casting a steel slab, followed by a step of reheating the steel slab to a temperature between 1050 and 1260° C.;

hot rolling the steel slab into a hot-rolled steel strip with an entry temperature for the final rolling stand between 980 and 1100° C.;

finishing said hot rolling at a finish rolling temperature between 950 and 1080° C.;

cooling the hot-rolled steel strip from the finish rolling temperature with a primary cooling rate between 50 and 150° C./s to an intermediate temperature on a run-out table (ROT) between 600 and 706° C.;

and followed by mild heating of the steel between 0 and +10° C./s from latent heat resulting from the austenite-to-ferrite phase transformation, or;

keeping the steel isothermal, or;

mild cooling the steel, leading overall to a temperature change rate in the secondary stage of the ROT of −20 to 0° C./s;

to reach a coiling temperature between 580 and 660° C. and then coiling the hot-rolled steel strip;

and wherein the steel consists of, in wt %:

between 0.015 and 0.15% C;

at most 0.5% Si;

between 1.0 and 2.0% Mn;

at most 0.06% P;

at most 0.008% S;

at most 0.1% of soluble Al;

at most 0.02% N;

between 0.02 and 0.45% V;

optionally one or more of at least 0.05 and/or at most 0.7% Mo;

at least 0.15 and/or at most 1.2% Cr;

at least 0.01 and/or at most 0.1% Nb;

optionally Ca in an amount between 5 and 100 ppm;

balance Fe and inevitable impurities;

and wherein the steel has single-phase ferritic microstructure that contains a mixture of polygonal ferrite (PF) and acicular and/or bainitic ferrite (AF/BF) and wherein the total volume fraction of the sum of said ferrite constituents is at least 95% and said ferrite constituents are strengthened with fine composite carbide and/or carbo-nitride precipitates containing V and optionally Mo and/or Nb.

2. The method according to claim 1, wherein no calcium treatment is used and any Ca present in the steel is an inevitable impurity and the steel contains at most 0.003 wt % of S.

3. The method according to claim 1, wherein the entry temperature for the entry temperature for the final rolling stand is between 980 and 1050° C. and the finish rolling temperature is between 950 and 1030° C.

4. The method according to claim 1, wherein the finish rolling temperature is between 950 and 1030° C.

5. The method according to claim 1, wherein the primary cooling rate is between 60 and 150° C./s or between 50 and 100° C./s to the intermediate temperature.

6. The method according to claim 1, wherein the cooling to the intermediate temperature is followed by:

mildly heating between 0 and +5° C./s due to latent heat resulting from the austenite-to-ferrite transformation, or;

keeping isothermal, or;

mildly cooling, leading overall to a temperature change rate in the secondary stage of the ROT of −15 to 0° C./s;

to reach the coiling temperature, wherein the coiling temperature between 600 and 600° C. or between 580 and 650° C.

7. The method according to claim 1, wherein the coiled hot-rolled steel strip is left to cool gradually to ambient temperature or is subjected to cooling by immersing the coiled hot-rolled steel strip into a water basin or by actively cooling the coiled hot-rolled steels trip with a spray of water to ambient temperature.

8. The method according to claim 1, wherein the hot-rolled strip after a surface-scale removal treatment is subjected to a coating process to ensure that the steel is corrosion protected with a zinc or zinc alloy coating.

9. The method according to claim 1, wherein the hot rolled steel strip has a single-phase ferritic microstructure that contains, in volume percent, a mixture of:

at most 60% of polygonal ferrite (PF) and at least 40% acicular and/or bainitic ferrite (AF/BF) or;

at most 50% polygonal ferrite and at least 50% acicular and/or bainitic ferrite or;

at most 30% polygonal ferrite and at least 70% acicular and/or bainitic ferrite.

10. The method according to claim 1, wherein a MisOrientation angle Distribution (MOD) index of the microstructure of the hot rolled steel strip as measured with the Electron BackScatter Diffraction (EBSD) technique is at least 0.45.

11. The method according to claim 1, wherein the hot rolled steel strip has a hole-expansion capacity (HEC) of 90% or higher, and wherein C level, in wt %, of the steel is between 0.02 and 0.05%;

wherein Si level, in wt %, of the steel is at most 0.25%;

wherein Mn level, in wt %, of the steel is between 1.0 and 1.8%;

wherein soluble Al level, in wt %, of the steel is at most 0.065%;

wherein N level, in wt %, of the steel is at most 0.013%;

wherein V level, in wt %, of the steel is between 0.12 and 0.18%;

wherein Nb level, in wt %, of the steel is between 0.02 and 0.08%;

and optionally wherein Cr level, in wt %, of the steel is between 0.20 and 0.60%.

12. The method according to claim 1, wherein the hot rolled steel strip has a tensile strength of at least 780 MPa and a hole-expansion capacity (HEC) of 65% or higher, and wherein C level, in wt %, of the steel is between 0.04 and 0.06%;

wherein Si level, in wt %, of the steel is at most 0.30%;

wherein Mn level, in wt %, of the steel is between 1.0 and 1.8%;

wherein soluble Al level, in wt %, of the steel is at most 0.065%;

wherein N level, in wt %, of the steel is at most 0.013%;

wherein V level, in wt %, of the steel is between 0.18 and 0.24%;

wherein Nb level, in wt %, of the steel is between 0.03 and 0.08%;

and optionally wherein Cr level, in wt %, of the steel is between 0.20 and 0.80%.

13. The method according to claim 1, wherein the hot rolled steel strip has a tensile strength of at least 980 MPa and a hole-expansion capacity (HEC) of 40% or higher, and wherein C level, in wt %, of the steel is between 0.08 and 0.12%;

wherein Si level, in wt %, of the steel is at most 0.45%;

wherein Mn level, in wt %, of the steel is between 1.0 and 2.0%;

wherein soluble Al level, in wt %, of the steel is at most 0.065%;

wherein N level, in wt %, of the steel is at most 0.013%;

wherein V level, in wt %, of the steel is between 0.24 and 0.32%;

wherein Nb level, in wt %, of the steel is between 0.03 and 0.08%;

and optionally wherein Cr level, in wt %, of the steel is between 0.20 and 1.0%.

14. The method according to claim 1, wherein the hot rolled steel strip has:

a HEC of 90% or higher, or a tensile strength of at least 780 MPa and a HEC of 65% or higher, or a tensile strength of at least 980 MPa and a HEC of 40% or higher, and wherein $(Rm \times A50)/t^{0.2} > 10000$, where Rm is ultimate tensile strength, in MPa, A50 is A50 tensile elongation, in MPa, and t is thickness, in mm.

15. The method according to claim 1, wherein the hot rolled steel strip has:

a HEC of 90% or higher, and in which the maximum fatigue stress is at least 280 MPa, at $1 \times 10^5$ cycles to failure with a stress ratio of 0.1 and a punching clearance of 8 to 15%, or;

a tensile strength of at least 780 MPa and a HEC of 65% or higher, and in which the maximum fatigue stress is at least 300 MPa, at $1 \times 10^5$ cycles to failure with a stress ratio of 0.1 and a punching clearance of 8 to 15%, or;

a tensile strength of at least 980 MPa and a HEC of 40% or higher, and in which the maximum fatigue stress is at least 320 MPa, at $1 \times 10^5$ cycles to failure with a tress ratio of 0.1 and a punching clearance of 8 to 15%;

and wherein $(Rm \times A50)/t^{0.2} > 10000$, where Rm is ultimate tensile strength, in MPa, A50 is A50 tensile elongation, in MPa, and t is thickness, in mm.

16. The method of claim 1, wherein the method manufactures a hot-rolled high-strength steel strip with a tensile strength of at least 780 MPa.

17. The method according to claim 2, wherein the steel contains at most 0.002 wt % of S.

18. The method according to claim 2, wherein the steel contains at most 0.001 wt % of S.

19. The method according to claim 5, wherein the intermediate temperature is at least 630° C. and at most 690° C.

20. The method according to claim 8, wherein the zinc alloy coating contains aluminium and/or magnesium as its main alloying elements.

21. The method according to claim 10, wherein the MisOrientation angle Distribution (MOD) index of the microstructure of the hot rolled steel strip as measured with the Electron BackScatter Diffraction (EBSD) technique is at least 0.60.

22. The method according to claim 10, wherein the MisOrientation angle Distribution (MOD) index of the microstructure of the hot rolled steel strip as measured with the Electron BackScatter Diffraction (EBSD) technique is at least 0.75.

23. The method according to claim 14, wherein the hot rolled steel strip has $(Rm \times A50)/t^{0.2} \geq 12000$.

24. The method according to claim 15, wherein the hot rolled steel strip has $(Rm \times A50)/t^{0.2} \geq 12000$.

25. The method according to claim 1, wherein the mild cooling of the steel leads overall to a temperature change rate in the secondary state of the ROT of −15 to 0° C./s.

26. The method according to claim 1, wherein the mild cooling of the steel leads overall to a temperature change rate in the secondary state of the ROT of −3.2 to −10.4° C./s.

* * * * *